US010815086B1

(12) United States Patent
Taki

(10) Patent No.: US 10,815,086 B1
(45) Date of Patent: Oct. 27, 2020

(54) SHEET BINDING APPARATUS AND IMAGE FORMING SYSTEM

(71) Applicant: TOSHIBA TEC KABUSHIKI KAISHA, Tokyo (JP)

(72) Inventor: Hiroyuki Taki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/566,488

(22) Filed: Sep. 10, 2019

(51) Int. Cl.

| | |
|---|---|
| ***B65H 5/06*** | (2006.01) |
| ***B42C 9/00*** | (2006.01) |
| ***B65H 37/02*** | (2006.01) |
| ***B65H 37/04*** | (2006.01) |
| ***B65H 29/12*** | (2006.01) |
| ***B65H 35/00*** | (2006.01) |
| ***G03G 15/00*** | (2006.01) |
| *B42C 19/08* | (2006.01) |

(52) U.S. Cl.

CPC ..... *B65H 5/06* (2013.01); *B42C 9/0056* (2013.01); *B42C 9/0062* (2013.01); *B65H 29/12* (2013.01); *B65H 29/125* (2013.01); *B65H 35/0066* (2013.01); *B65H 37/02* (2013.01); *B65H 37/04* (2013.01); *G03G 15/6544* (2013.01); *B42C 19/08* (2013.01); *B65H 2301/43821* (2013.01); *B65H 2301/5113* (2013.01); *B65H 2801/27* (2013.01); *G03G 2215/00839* (2013.01); *G03G 2215/00848* (2013.01)

(58) Field of Classification Search

CPC ..... B42C 9/0056; B42C 9/0062; G03G 15/6544; G03G 2215/00839; G03G 2215/00848; B65H 5/06; B65H 29/12; B65H 29/125; B65H 37/02; B65H 37/04; B65H 35/0066; B65H 2301/43821; B65H 2301/5113; B65H 2801/27

USPC ..... 270/58.07, 58.08

See application file for complete search history.

(56) References Cited

U.S. PATENT DOCUMENTS

| | | | | |
|---|---|---|---|---|
| 6,024,525 | A * | 2/2000 | Yamanaka | B42C 9/0075 412/11 |
| 10,031,465 | B2 * | 7/2018 | Sunaoshi | B65H 37/04 |
| 10,202,252 | B2 * | 2/2019 | Mizutani | B65H 35/0006 |
| 10,252,877 | B2 * | 4/2019 | Sunaoshi | B65H 35/0066 |

(Continued)

OTHER PUBLICATIONS

U.S. Appl. No. 16/280,368, filed Feb. 20, 2019 (First Inventor: Kikuo Mizutani).

(Continued)

*Primary Examiner* — Leslie A Nicholson, III

(74) *Attorney, Agent, or Firm* — Kim & Stewart LLP

(57) ABSTRACT

A sheet binding apparatus includes a sheet conveyer, a tape holder, and first and second rollers. The sheet conveyer is configured to convey a sheet bundle with a leading end shifted, the sheet bundle having opposing first and second surfaces. The tape holder is configured to hold a tape at a position to which the leading end reaches such that the tape adheres to the leading end. The leading end with the tape passes and is pressed between the first and second rollers. The second roller is positioned upstream in the sheet forward direction from the first roller and to face the second surface of the sheet bundle. An angle between a line perpendicular to the sheet forward direction and a line passing rotational axes of the first and second rollers is greater than 0° and less than 90°.

20 Claims, 21 Drawing Sheets

(56) References Cited

U.S. PATENT DOCUMENTS

| | | | | |
|---|---|---|---|---|
| 10,343,442 | B2 * | 7/2019 | Tsuchihashi | B31F 5/06 |
| 2018/0001688 | A1 * | 1/2018 | Sasahara | B42B 5/04 |

OTHER PUBLICATIONS

U.S. Appl. No. 16/280,067, filed Feb. 20, 2019 (First Inventor: Kikuo Mizutani).

* cited by examiner

SHEET BINDING APPARATUS AND IMAGE FORMING SYSTEM

FIELD

Embodiments described herein relate generally to a sheet binding apparatus and an image forming system.

BACKGROUND

A sheet binding apparatus binds an edge portion of a sheet bundle with an adhesive tape. The sheet binding apparatus includes a first roller, a second roller, and a tape holding section. The first roller and the second roller are opposed to each other in a thickness direction of the sheet bundle. The sheet bundle is shifted stepwise so as to provide a sufficient surface area during tape attachment. The tape holding section holds the adhesive tape for binding the sheet bundle shifted stepwise. The adhesive tape is peeled from the tape holding section by inserting the stepwise shifted sheet bundle facing the adhesive tape held by the tape holding section. Thereafter, the sheet bundle is passed between the first roller and the second roller together with the adhesive tape to secure the adhesive tape to the edge portion of the sheet bundle.

However, if a large number of sheets (e.g., three or more sheets) are being bound into the sheet bundle, a pressing force between the first roller and the second roller may not be uniformly applied to step-like end faces of the sheet bundle and the adhesive tape. If the pressing force between the rollers is not uniformly applied the adhesive tape may not be sufficiently adhered to the edge portion of the sheet bundle.

DESCRIPTION OF THE DRAWINGS

FIG. 3A illustrates a relatively small shift amount among the sheets and FIG. 3B illustrates a relatively large shift amount among the sheets.

DETAILED DESCRIPTION

Figure 1:
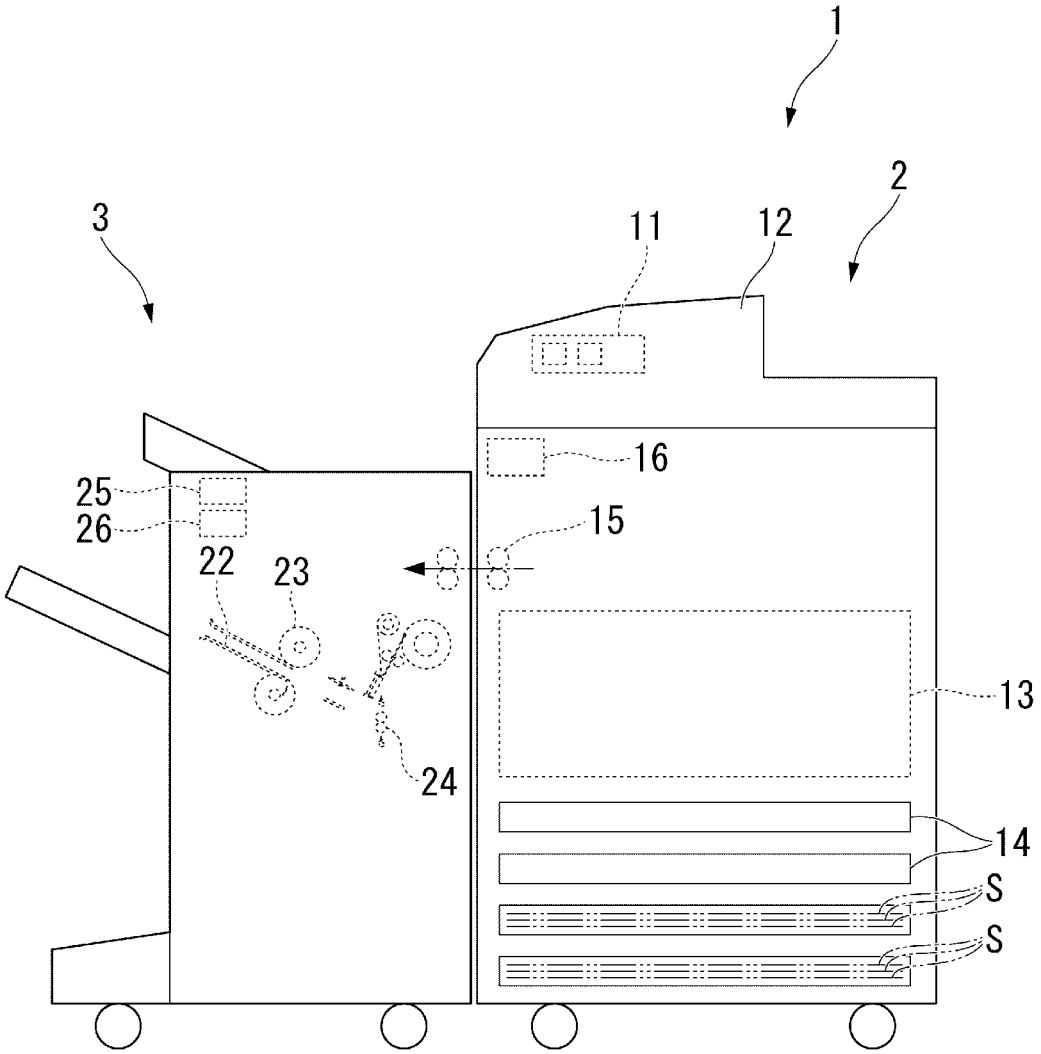
FIG. 1 illustrates a front view of an image forming system according to a first embodiment.

A sheet binding apparatus according to an embodiment includes a sheet conveyer, a tape holder, and first and second rollers. The sheet conveyer is configured to convey a sheet bundle with a leading end thereof in a sheet forward direction shifted in a stepwise manner, the sheet bundle having opposing first and second surfaces. The tape holder is configured to hold a tape at a position to which the leading end of the sheet bundle reaches as the sheet bundle is conveyed in the sheet forward direction by the sheet conveyer such that the tape adheres to the leading end of the sheet bundle. The leading end of the sheet bundle with the tape passes and is pressed between the first and second rollers as the sheet bundle is conveyed in the forward direction. The second roller is positioned upstream in the sheet forward direction from the first roller and faces the second surface of the sheet bundle. An angle between a first straight line perpendicular to the sheet forward direction and a second straight line passing a rotational axis of the first roller and a rotational axis of the second roller is greater than 0° and less than 90°.

Sheet binding apparatuses and image forming systems according to embodiments are described below with reference to the drawings. In the figures, the same components are denoted by the same reference numerals and signs. Redundant description of the components may be omitted. In this application, various sheet-like media including paper is referred to as "sheet".

First, one embodiment is described with reference to FIGS. 1 to 11.

FIG. 1 illustrates a front view of an image forming system 1 according to an embodiment. The image forming system 1 according to this embodiment includes a sheet binding apparatus 3 that binds an edge portion 5*a* (see FIG. 10) of a sheet bundle 5 with a tape. For example, the sheet binding apparatus 3 is a post-processing apparatus that is disposed adjacent to an image forming apparatus 2 and performs post-processing on sheets S conveyed from the image forming apparatus 2.

First, the image forming apparatus 2 is briefly described.

As illustrated in FIG. 1, the image forming apparatus 2 includes a control panel 11, a scanner section 12, a printer section 13, a paper feeding section 14, a paper discharging section 15, and a control section 16.

The control panel 11 includes various keys. The control panel 11 receives operation by a user.

The scanner section 12 reads image information of a copying target object.

The printer section 13 forms an image on the sheet S based on image information received from the scanner section 12 or an external apparatus.

The paper feeding section 14 feeds the sheet S to the printer section 13.

The paper discharging section 15 conveys the sheet S discharged from the printer section 13 to the sheet binding apparatus 3.

The control section 16 controls various operations of the control panel 11, the scanner section 12, the printer section 13, the paper feeding section 14, and the paper discharging section 15.

The sheet binding apparatus 3 is described below.

The sheet binding apparatus 3 includes a bundle forming section 22, a sheet shifting section 23, a tape processing section 24, a storing section 25, and a control section 26.

The bundle forming section 22 is described.

Figure 2:
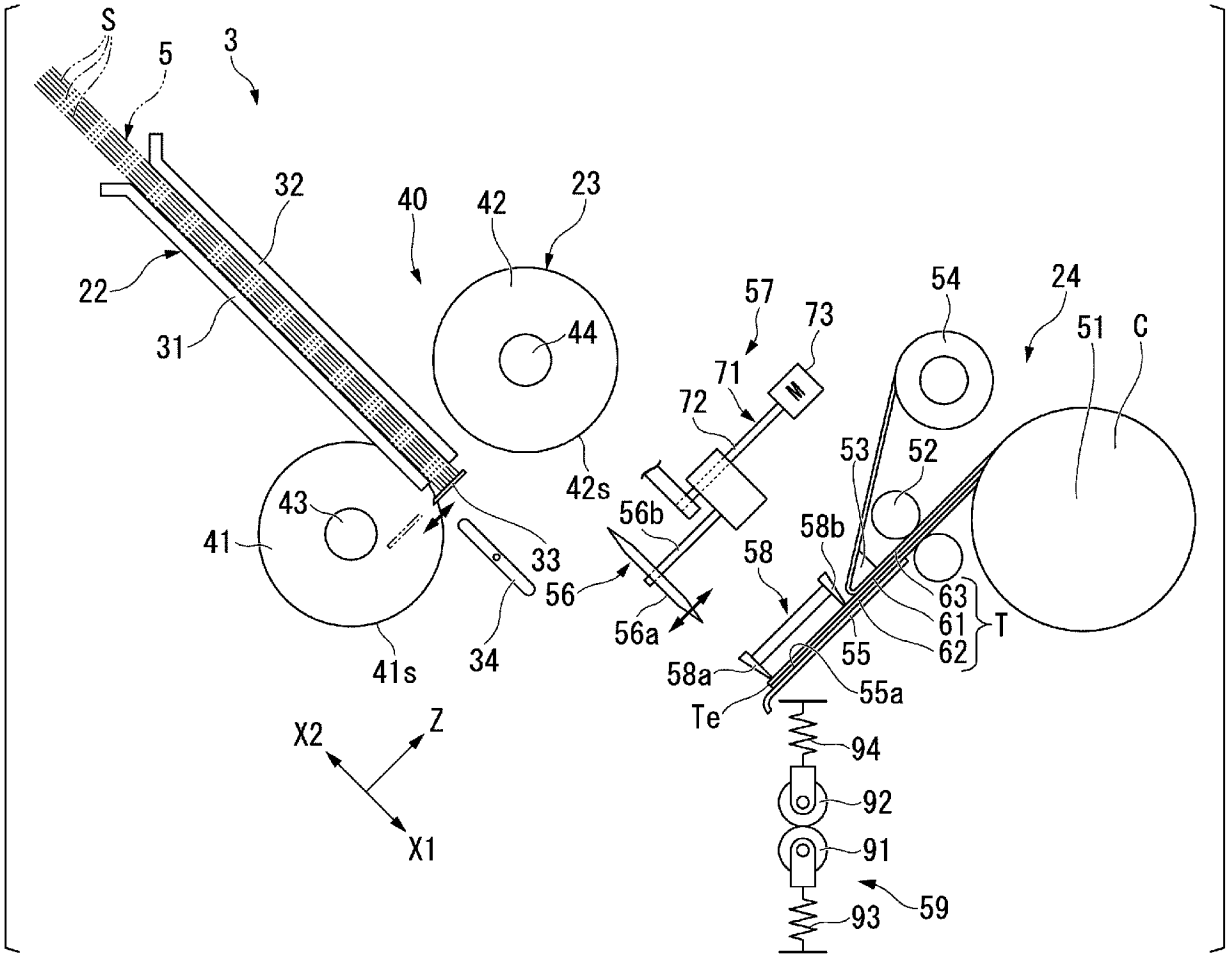
FIG. 2 illustrates a front view of a sheet binding apparatus according to the first embodiment.

FIG. 2 illustrates a front view of the sheet binding apparatus 3.

As illustrated in FIG. 2, the bundle forming section 22 superimposes a plurality of sheets S to form the sheet bundle 5. The bundle forming section 22 includes a main guide 31, a sub-guide 32, a stopper 33, and a switching member 34.

The main guide 31 guides the sheet S along a sheet conveying direction X1. The plurality of sheets S are stacked in order on the main guide 31 to form the sheet bundle 5. The main guide 31 guides the sheet bundle 5 toward between a first roller 91 and a second roller 92. A downstream-side end portion of the main guide 31 in the sheet conveying direction X1 is formed in a comb teeth shape to avoid a first shifting roller 41 of the sheet shifting section 23.

The sub-guide 32 faces the main guide 31 in a thickness direction Z of the sheet bundle 5 (hereinafter referred to as sheet bundle thickness direction Z). A space in which the sheets S are stacked is provided between the main guide 31 and the sub-guide 32. A downstream-side end portion of the sub-guide 32 in the sheet conveying direction X1 is formed in a comb teeth shape to avoid a second shifting roller 42 of the sheet shifting section 23.

The stopper 33 is provided at the downstream-side end portion of the main guide 31 in the sheet conveying direction X1. The stopper 33 is movable between a restriction position (indicated by a solid line in FIG. 2) and a release position (indicated by an alternate long and two short dashes line in FIG. 2) by a not-illustrated moving mechanism. In the restriction position, the stopper 33 projects further upward than the upper surface of the main guide 31. In the restriction position, an end portion of the sheet S comes into contact with the stopper 33, whereby the stopper 33 stops the sheet S. Therefore, the sheets S accumulate on the main guide 31 and the sheet bundle 5 is formed. On the other hand, in the release position, the stopper 33 retracts further downward than the upper surface of the main guide 31. In the release position, the stopper 33 allows the sheet bundle 5 on the main guide 31 to pass toward the switching member 34.

The switching member 34 switches a conveying path of the sheet bundle 5. In the following description, a direction in which the sheet bundle 5 is conveyed toward the tape processing section 24 (specifically, a tape attaching section 59) is referred to as "first conveying direction (entering direction)". On the other hand, a direction in which the sheet bundle 5 is conveyed toward a position (e.g., below the bundle forming section 22) different from the tape attaching section 59 is referred to as "second conveying direction". The switching member 34 switches the conveying path of the sheet bundle 5 between the first conveying direction and the second conveying direction.

The sheet shifting section 23 is described below.

The sheet shifting section 23 shifts the plurality of sheets S in the sheet conveying direction X1 in order little by little to form a state in which the plurality of sheets S forming the sheet bundle 5 are shifted from one another at the edge portion 5*a* of the sheet bundle 5. For example, the sheet shifting section 23 forms a state in which the plurality of sheets S are shifted stepwise at the edge portion 5*a* of the sheet bundle 5.

The sheet shifting section 23 includes the first shifting roller 41 and the second shifting roller 42. The first shifting roller 41 and the second shifting roller 42 forms an example of a "bundle conveying section 40" in cooperation. The bundle conveying section 40 conveys the sheet bundle 5 located between the main guide 31 and the sub-guide 32 toward between the first roller 91 and the second roller 92.

The first shifting roller 41 is attached to a first shaft 43. For example, the first shifting roller 41 is a driving roller driven by a not-illustrated motor via the first shaft 43. The first shifting roller 41 is fixed in a fixed position. The material of the first shifting roller 41 is not particularly limited. For example, the first shifting roller 41 is formed of ethylene propylene diene rubber (EPDM).

The second shifting roller 42 is attached to a second shaft 44. For example, the second shifting roller 42 is a driven roller that rotates according to rotation of the first shifting roller 41. The second shifting roller 42 is movable in a direction approaching the first shifting roller 41 and a direction away from the first shifting roller 41 by a not-illustrated moving mechanism. The second shifting roller 42 is moved toward the first shifting roller 41 to come into contact with the sheet bundle 5 from the opposite side of the first shifting roller 41.

An outer circumferential surface 42*s* of the second shifting roller 42 is softer than an outer circumferential surface 41*s* of the first shifting roller 41 and is deformable along the surface of the sheet bundle 5. For example, the second shifting roller 42 is formed of sponge, rubber including a hollow on the inside, or the like. If the second shifting roller 42 is brought close to the first shifting roller 41, the outer circumferential surface 42*s* of the second shifting roller 42 is deformed in an arcuate shape conforming to the outer circumferential surface 41*s* of the first shifting roller 41 together with the sheet bundle 5.

Figure 3A:
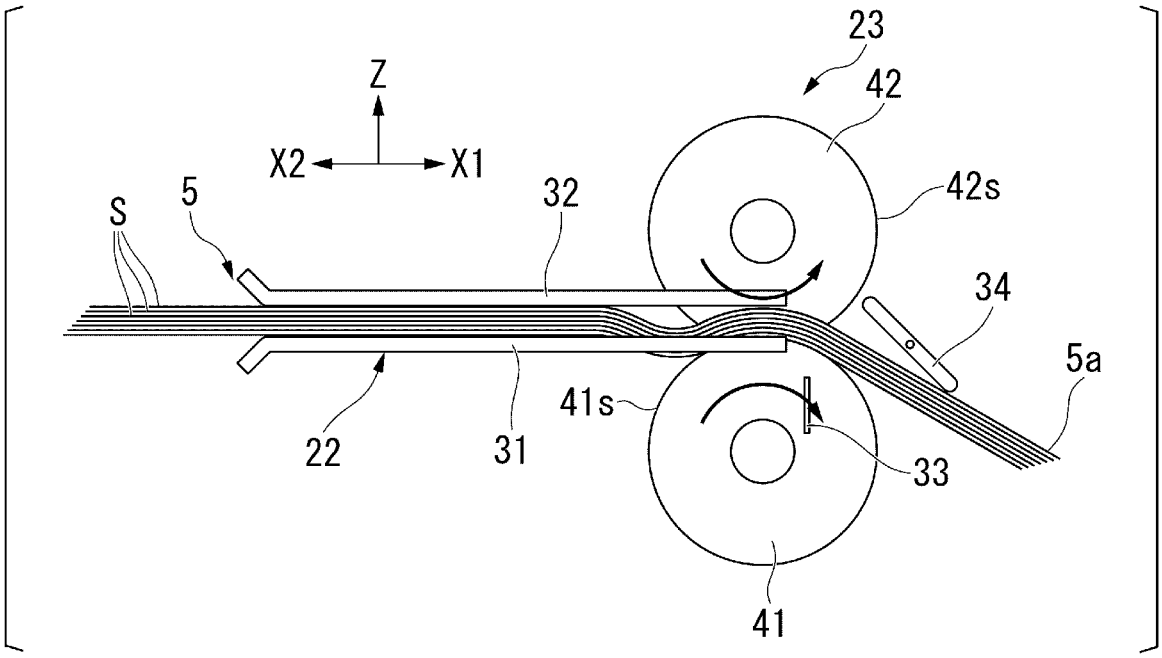
FIGS. 3A and 3B are diagrams illustrating operation for changing a shift amount among sheets.
Figure 3B:
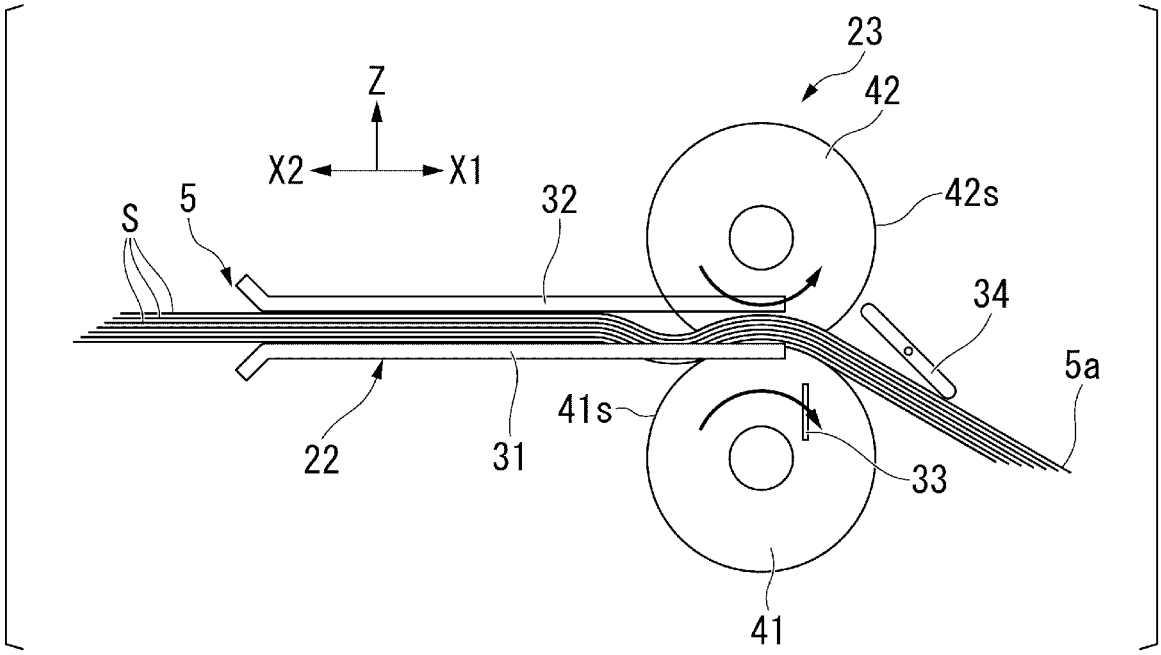

FIGS. 3A and 3B are diagrams illustrating an operation for changing a shift amount d among the sheets S with the shift shifting section 23. FIG. 3A illustrates a relatively small shift amount d among the sheets S. On the other hand, FIG. 3B illustrates a relatively large shift amount d among the sheets S.

As illustrated in FIGS. 3A and 3B, the sheet shifting section 23 can reduce the shift amount d among the sheets S by setting a rotation angle of the first shifting roller 41 smaller than a reference amount set in advance. On the other hand, the sheet shifting section 23 can increase the shift amount d among the sheets S by setting the rotation angle of the first shifting roller 41 larger than the reference amount.

Figure 4:
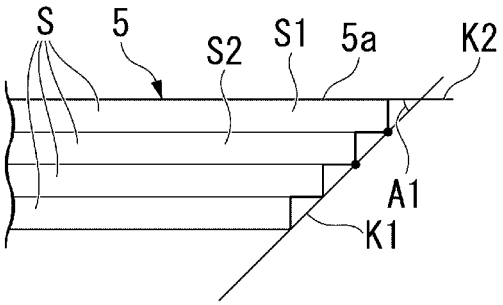
FIG. 4 is a diagram depicting a shift angle of an edge portion of a sheet bundle.

The sheet shifting section 23 is capable of changing an inclination angle (hereinafter referred to as "shift angle" as well) of a step-like end face (hereinafter referred to as "step end face" as well) of the sheet bundle 5. In FIG. 4, an imaginary straight line passing a corner of a first sheet S1 and a corner of a second sheet S2 among the plurality of sheets S forming the sheet bundle 5 is represented as a first imaginary straight line K1 and an imaginary straight line along the entire surface of the first sheet S1 is represented as a second imaginary straight line K2. A shift angle A1 means an angle formed by the first imaginary straight line K1 and the second imaginary straight line K2. The sheet shifting section 23 sets the shift angle A1 to an acute angle. For example, the shift angle A1 is set to 15° or more and 60° or less. In this embodiment, the shift angle A1 is set to a specific angle (e.g., approximately 45°).

The tape processing section 24 is described below.

As illustrated in FIG. 2, the tape processing section 24 includes an unwinding section 51, a tape conveying section 52, a separating member 53, a winding section 54, a guide table 55, a cutter 56, a cutting-length changing section 57, a tape holding section 58, and the tape attaching section 59.

The unwinding section 51 is an example of a "tape supplying section". For example, the unwinding section 51 holds a web roll on which a belt-like tape T (hereinafter simply referred to as "tape T") is wound. The unwinding section 51 supplies the tape T along the length direction of the tape T. The tape T includes an adhesive layer 61, a protective film (a first film) 62, and a release film (a second film) 63 in a state in which the tape T is held by the unwinding section 51. The protective film 62 covers the adhesive layer 61 from one side. The protective film 62 is integral with the adhesive layer 61 during use of the tape T. On the other hand, the release film 63 covers the adhesive layer 61 from the opposite side of the protective film 62. The release film 63 is peeled from the adhesive layer 61 before the use of the tape T. The release film 63 is wound by the separating member 53 and the winding section 54.

The tape conveying section 52 conveys the tape T supplied from the unwinding section 51 along the length direction of the tape T. For example, the length direction of the tape T is a direction substantially parallel to the sheet bundle thickness direction Z. For example, the tape conveying section 52 is a conveying roller pair that conveys the tape T.

The guide table 55 is an example of a tape conveyance guide that forms a conveying path of the tape T. The guide table 55 guides the tape T from which the release film 63 is separated. The guide table 55 supports the tape T during holding and during cutting of the tape T. A conveying direction of the tape T (the length direction of the tape T) crosses the vertical plane.

The cutter 56 cuts the belt-like tape T supplied from the unwinding section 51 to obtain a shingle piece of the tape T. For example, the cutter 56 is a rotor cutter. The cutter 56 includes a cutting edge 56*a* and a supporting shaft 56*b*. The supporting shaft 56*b* is rotated by a not-illustrated motor, whereby the cutting edge 56*a* is driven to rotate. The configuration of the cutter 56 is not limited to the example described above. The configuration of the cutter 56 may be any configuration if the cutter 56 can cut the tape T supplied from the unwinding section 51. The cutter 56 is movable in a direction approaching the tape T and a direction away from the tape T by a not-illustrated moving mechanism.

The cutting-length changing section 57 changes length L (see FIG. 8) of the tape T cut by the cutter 56. "The length L of the tape" in this application is the length (the width) of the tape T in the sheet bundle thickness direction Z. In other words, "the length L of the tape" is length in a direction for wrapping the edge portion 5*a* of the sheet bundle 5 from a first surface 7*a* toward a second surface 7*b* of the sheet bundle 5.

The cutting-length changing section 57 includes a moving mechanism 71 that changes a relative position of the cutter 56 with respect to a leading end Te of the tape T supplied from the unwinding section 51. For example, the moving mechanism 71 moves the cutter 56 to change the relative position of the cutter 56 with respect to the leading end Te of the tape T. For example, the moving mechanism 71 moves the cutter 56 along the sheet bundle thickness direction Z. "The relative position of the cutter 56 with respect to the leading end Te of the tape T" is, for example, a relative position of the cutter 56 with respect to the leading end Te of the tape T at the time when the tape T is cut by the cutter 56.

In this embodiment, the moving mechanism 71 includes a supporting member 72 that supports the cutter 56 and a driving source 73 that moves the cutter 56 via the supporting member 72. For example, the supporting member 72 is a ball screw coupled to the cutter 56. The driving source 73 is a motor that drives the ball screw to move the cutter 56. The configurations of the supporting member 72 and the driving source 73 are not limited to the example described above. For example, the supporting member 72 may be a cam or the like that is in contact with the cutter 56. The driving source 73 may be a solenoid that moves the cutter 56 via the supporting member 72. In this case, the supporting member 72 is a coupling member that couples the cutter 56 and the solenoid.

The configuration of the moving mechanism 71 is not limited to the example described above. For example, the moving mechanism 71 may change a letting-out length of the tape T with respect to the cutter 56 fixed in a fixed position to change the relative position of the cutter 56 with respect to the leading end Te of the tape T.

In this embodiment, the cutting-length changing section 57 is controlled by the control section 26 (see FIG. 1). For example, the control section 26 controls the driving source 73 of the cutting-length changing section 57 to move the cutter 56 and change the length L of the tape T cut by the cutter 56. For example, the cutting-length changing section 57 is controlled by the control section 26, whereby the operation of the cutting-length changing section 57 described below is performed.

In this embodiment, the cutting-length changing section 57 changes, based on the shift amount d among the sheets S changed by the control section 26, the length of the tape T cut by the cutter 56. For example, if the shift amount d among the sheets S is increased by the control section 26, the cutting-length changing section 57 increases the length L of the tape T cut by the cutter 56. On the other hand, if the shift amount d among the sheets S is reduced by the control section 26, the cutting-length changing section 57 reduces the length L of the tape T cut by the cutter 56.

The tape holding section 58 supports the tape T in a state in which a posture of the tape T is retained substantially flat. The tape holding section 58 is movable along the length direction of the tape T by a not-illustrated moving mechanism. The tape holding section 58 is movable in a direction approaching the tape T and a direction away from the tape T by the not-illustrated moving mechanism.

The tape holding section 58 includes a first tape supporting section 58*a* and a second tape supporting section 58*b* that support the tape T. Each of the first tape supporting section 58*a* and the second tape supporting section 58*b* extends along the entering direction (the sheet conveying direction X1). The first tape supporting section 58*a* and the second tape supporting section 58*b* are disposed at an interval from each other in the conveying direction of the tape T. Each of the first tape supporting section 58*a* and the second tape supporting section 58*b* has a sharp shape tapered toward an adhesive surface of the tape T (an adhesive surface of the adhesive layer 61).

The tape attaching section 59 (a tape wrapping section) includes the first roller 91, the second roller 92, a first spring 93 (a first urging member), and a second spring 94 (a second urging member). The first roller 91 and the second roller 92 are disposed side by side in a direction obliquely crossing the conveying direction of the tape T (the sheet bundle thickness direction Z).

Each of the first roller 91 and the second roller 92 has a perfect circular shape. If the tape T is attached to the edge portion 5*a* of the sheet bundle 5, the first roller 91 is opposed to a step end face 7*c* of the sheet bundle 5 (see FIG. 10). In this case, the first roller 91 is in contact with the step end face 7*c* of the sheet bundle 5 via the tape T. For example, the first roller 91 is formed of an elastic material such as rubber.

Figure 10:
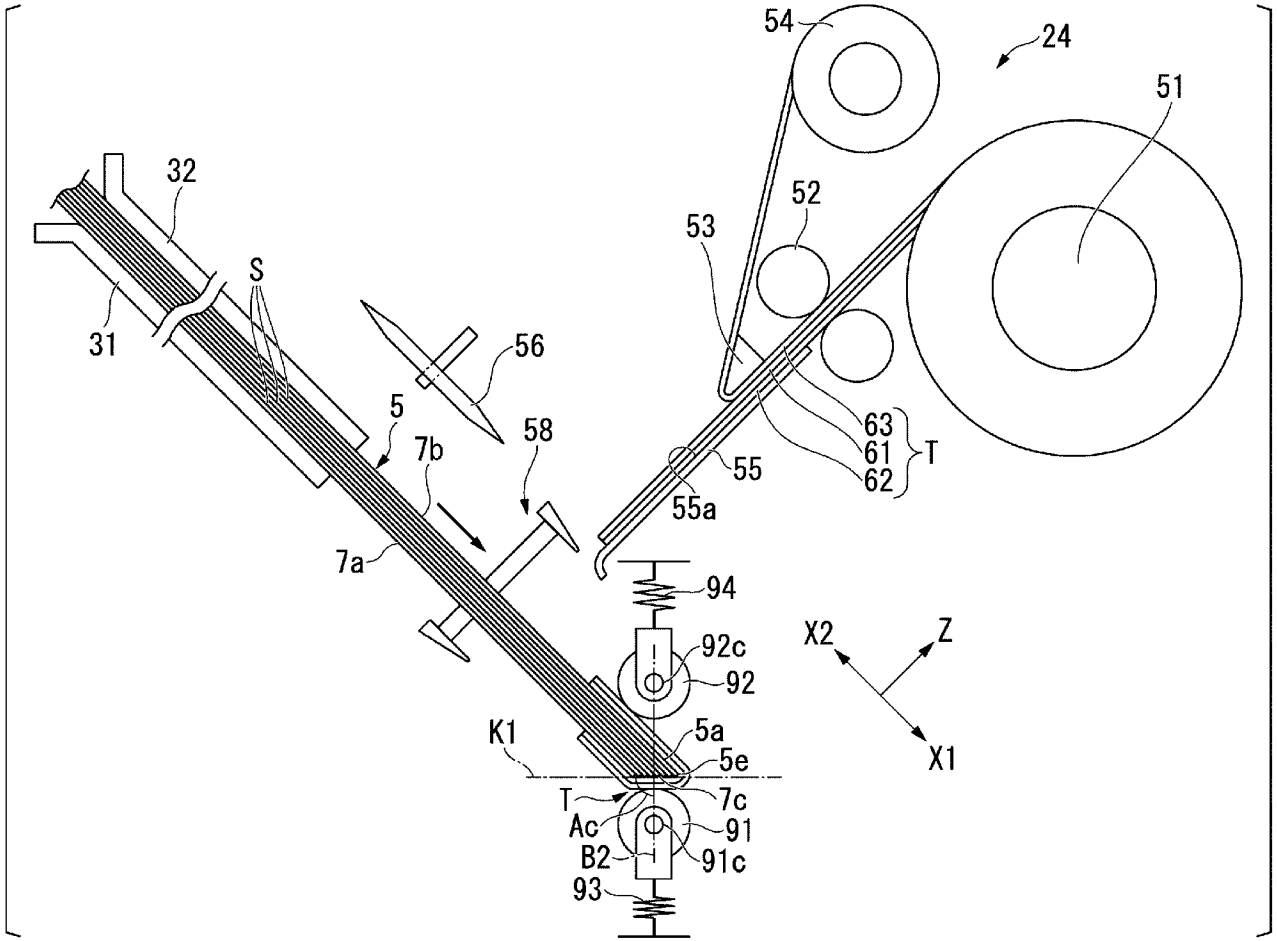

If the tape T is attached to the edge portion 5*a* of the sheet bundle 5, the second roller 92 is opposed to a surface (the second surface 7*b*) on the opposite side of the step end face 7*c* of the sheet bundle 5 (see FIG. 10). The second roller 92 has rigidity larger than the rigidity of the first roller 91. For example, the second roller 92 is formed of an elastic material or a resin material less easily deformed than the first roller 91.

Figure 5:
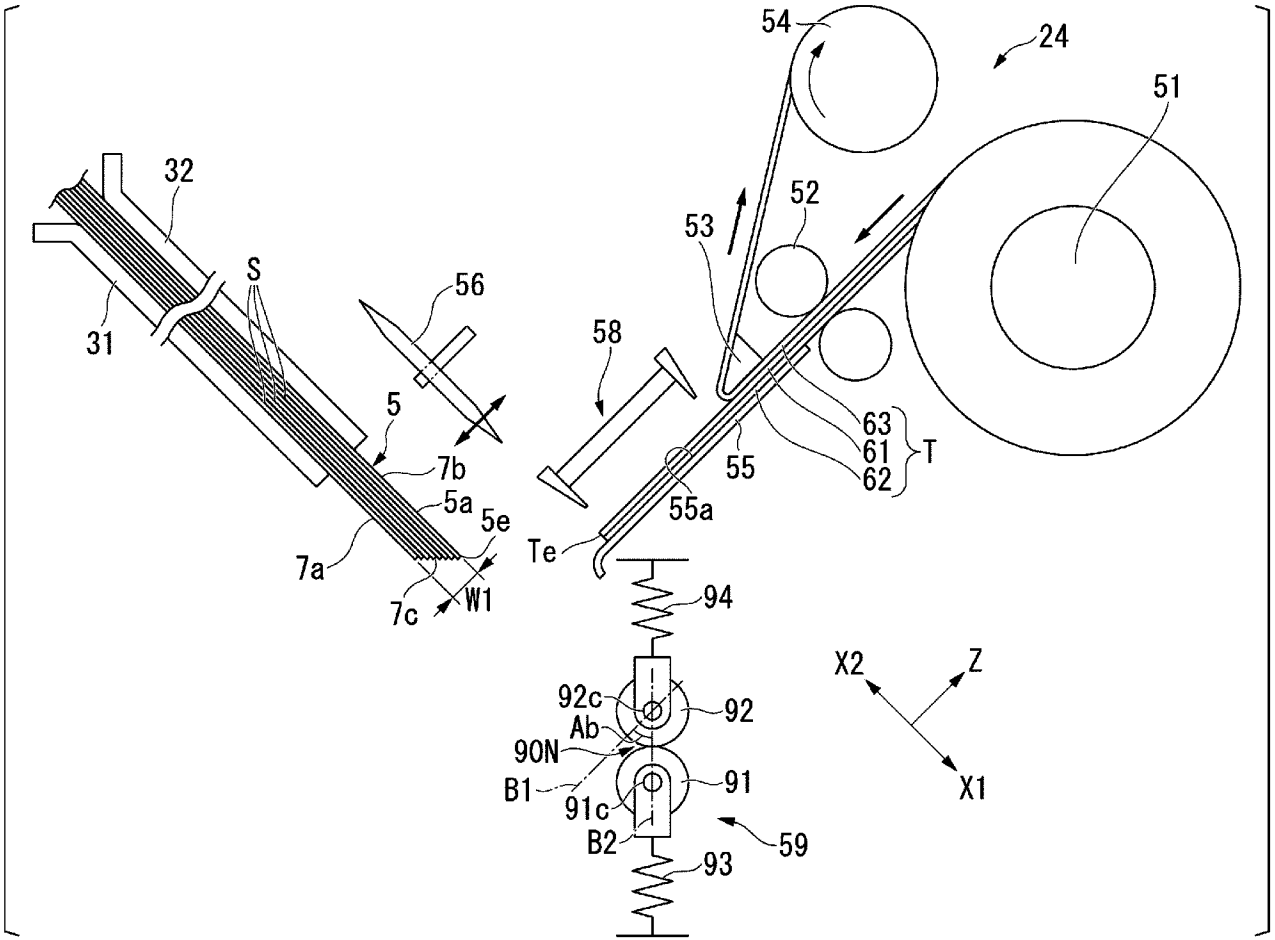
FIGS. 5-11 illustrate a front view of the sheet binding apparatus performing operations associated with sheet binding.

In FIG. 5, an imaginary straight line orthogonal to the entering direction when viewed from the axial direction of the first roller 91 (a surface orthogonal to a rotation axis 91*c*) is represented as a first straight line B1. An imaginary straight line passing the center of the first roller 91 and the center of the second roller 92 when viewed from the axial direction of the first roller 91 is represented as a second straight line B2. An angle formed by the first straight line B1 and the second straight line B2 when viewed from the axial direction of the first roller 91 is represented as Ab. A direction (a counterclockwise direction) in which the second straight line B2 is separated from the main guide 31 (the step end face 7*c* of the sheet bundle 5) based on the center of the second roller 92 (a rotation reference) is represented as a plus direction. That is, a direction in which the second straight line B2 is rotated, based on the center of the second roller 92, from a position parallel to the first straight line B1 to the side of the entering direction when viewed from the axial direction of the first roller 91 is represented as a plus direction. In this case, $0° < Ab < 90°$ is satisfied.

If the shift angle A1 is set to 45°, the angle Ab desirably satisfies $10° < Ab < 80°$. If the shift angle A1 is set to 45°, the angle Ab more desirably satisfies $20° < Ab < 70°$ and still more desirably satisfies $30° < Ab < 60°$. In the embodiment, if the shift angle A1 is set to 45°, the angle Ab is set to approximately 45°. If the shift angle A1 is set to 45°, the angle Ab is desirably closer to 45°.

The first roller 91 is located on a downstream side of the second roller 92 in the entering direction. The first roller 91 is offset further to the downstream side than the second roller 92 by approximately a half of the roller in the entering direction.

The first roller 91 is in contact with the step end face 7*c* of the sheet bundle 5 via the tape T in a state in which the second straight line B2 is substantially orthogonal to the step end face 7*c* of the sheet bundle 5 (see FIG. 10). "Substantially orthogonal" means that the second straight line B2 is substantially orthogonal to the step end face 7*c* of the sheet bundle 5 within an allowable range of a setting error of the shift angle A1. The setting error of the shift angle A1 includes fluctuation in an angle due to the thickness of a sheet, the material of the sheet, and the like. "Substantially orthogonal" includes complete orthogonality of the second straight line B2 to the step end face 7*c* of the sheet bundle 5.

An angle Ac (hereinafter referred to as "contact angle Ac" as well) formed by the step end face 7*c* of the sheet bundle 5 (the first imaginary straight line K1) and the second straight line B2 is desirably closer to 90° (see FIG. 10). For example, the contact angle Ac is set to 80° or more and 100° or less (90°±10°).

The first spring 93 urges the first roller 91 toward the second roller 92. The second spring 94 urges the second roller 92 toward the first roller 91. The first roller 91 and the first spring 93 form an example of a "first urging section" in cooperation. The second roller 92 and the second spring 94 form an example of a "second urging section" in cooperation. If the tape T is attached, the edge portion 5*a* of the sheet bundle 5 is inserted between the first roller 91 and the second roller 92 together with the tape T. Consequently, the tape T is bent by the tape attaching section 59 to wrap the edge portion 5*a* of the sheet bundle 5. The tape T is attached to the edge portion 5*a* of the sheet bundle 5.

The first spring 93 has a first spring constant F1. The second spring 94 has a second spring constant F2 larger than the first spring constant F1 (F2>F1).

In FIG. 5, a sign W1 indicates the thickness of the sheet bundle 5. Before the sheet bundle 5 is inserted between the first roller 91 and the second roller 92, an interval between the first roller 91 and the second roller 92 (hereinafter referred to as "roller interval" as well) is equal to or smaller than the thickness W1 of the sheet bundle 5. In this embodiment, before the sheet bundle 5 is inserted between the first roller 91 and the second roller 92, the roller interval is zero. In other words, before the sheet bundle 5 is inserted between the first roller 91 and the second roller 92, the first roller 91 and the second roller 92 are in contact with each other.

The control section 26 (see FIG. 1) is formed by a control circuit or the like including a CPU, a ROM, and a RAM provided in the sheet binding apparatus 3. A processor such as the CPU executes a computer program, whereby the control section 26 controls the operation of the sheet binding apparatus 3. For example, the control section 26 controls various operations of the bundle forming section 22, the sheet shifting section 23, and the tape processing section 24.

An operation example of the sheet binding apparatus 3 is described. FIGS. 5 to 11 illustrate front views of the sheet binding apparatus 3 illustrating an operation example.

First, as illustrated in FIG. 2, the sheet binding apparatus 3 moves the stopper 33 to the restriction position to stop the sheet S conveyed to the main guide 31. Consequently, the plurality of sheets S are stacked in order and the sheet bundle 5 is formed. Subsequently, the sheet binding apparatus 3 moves the stopper 33 to the release position. The sheet binding apparatus 3 switches the switching member 34 toward the second conveying direction.

Subsequently, as illustrated in FIGS. 3A and 3B, the sheet binding apparatus 3 moves the second shifting roller 42 toward the first shifting roller 41. Consequently, the sheet bundle 5 and the outer circumferential surface 42*s* of the second shifting roller 42 are deformed in an arcuate shape conforming to the outer circumferential surface 41*s* of the first shifting roller 41. The sheet binding apparatus 3 normally rotates the first shifting roller 41 in a state in which the sheet bundle 5 is held between the first shifting roller 41 and the second shifting roller 42.

Consequently, the second shifting roller 42 rotates according to the rotation of the first shifting roller 41 while maintaining a state in which the second shifting roller 42 is recessed along the outer circumferential surface 42*s* of the first shifting roller 41. As a result, a state in which the plurality of sheets S are shifted stepwise in the sheet conveying direction X1 at the edge portion 5*a* of the sheet bundle 5 is formed. "The edge portion 5*a* of the sheet bundle 5" in the following description means the edge portion 5*a* of the sheet bundle 5 in which the plurality of sheets S are shifted stepwise.

Subsequently, the sheet binding apparatus 3 moves the second shifting roller 42 in a direction away from the first shifting roller 41. Consequently, the recess of the outer circumferential surface 42*s* of the second shifting roller 42 is eliminated. Subsequently, the sheet binding apparatus 3 reversely rotates the first shifting roller 41 and the second shifting roller 42 to move the sheet bundle 5 toward an opposite direction X2 of the sheet conveying direction X1. Subsequently, the sheet binding apparatus 3 switches the switching member 34 to switch the conveying path from the second conveying direction to the first conveying direction. The sheet binding apparatus 3 normally rotates the first shifting roller 41 and the second shifting roller 42 to move the sheet bundle 5 toward the tape attaching section 59.

As illustrated in FIG. 5, before the sheet bundle 5 is inserted between the first roller 91 and the second roller 92, the sheet binding apparatus 3 sets the roller interval to the thickness of the sheet bundle 5 or less. In this embodiment, before the sheet bundle 5 is inserted between the first roller 91 and the second roller 92, the sheet binding apparatus 3 brings the first roller 91 and the second roller 92 into contact to set the roller interval to zero. Before the sheet bundle 5 is inserted between the first roller 91 and the second roller 92, the sheet binding apparatus 3 forms a nip 90N with the first roller 91 and the second roller 92.

The sheet binding apparatus 3 according to this embodiment sets, based on the set shift angle A1 (e.g., approximately 45°), the length L of the tape T cut by the cutter 56. For example, in this embodiment, the control section 26 controls the driving source 73 (see FIG. 2) of the cutting-length changing section 57, whereby the position of the cutter 56 is changed.

Figure 6:
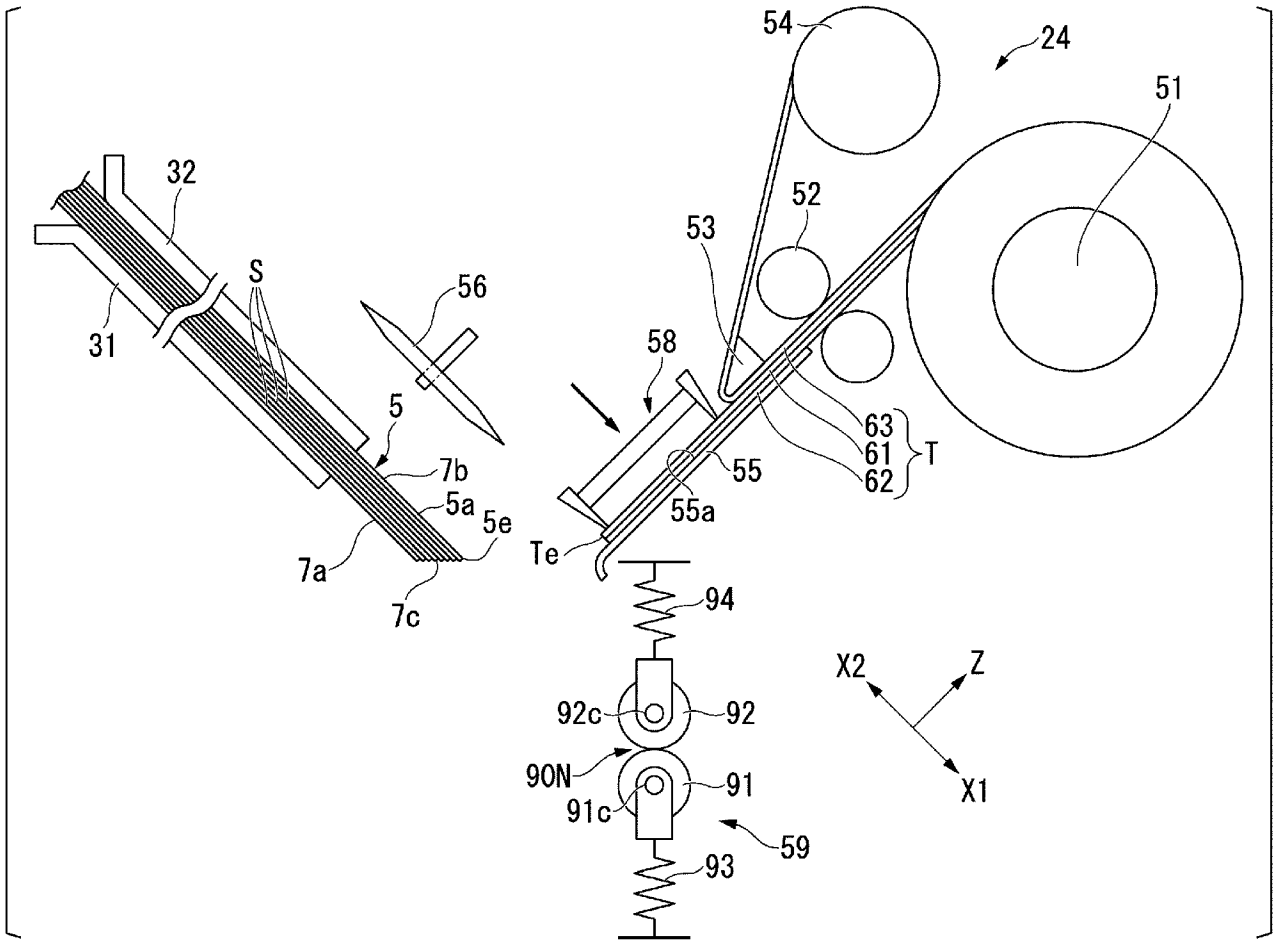

Subsequently, as illustrated in FIG. 6, the sheet binding apparatus 3 brings the tape holding section 58 into contact with the tape T to support the tape T in a state in which the posture of the tape T is retained. In this embodiment, the sheet binding apparatus 3 brings the tape holding section 58 into contact with both ends (an upstream end and a downstream end in the conveying direction of the tape T) of the guide table 55 to support the substantially flat (linear) tape T.

Figure 7:
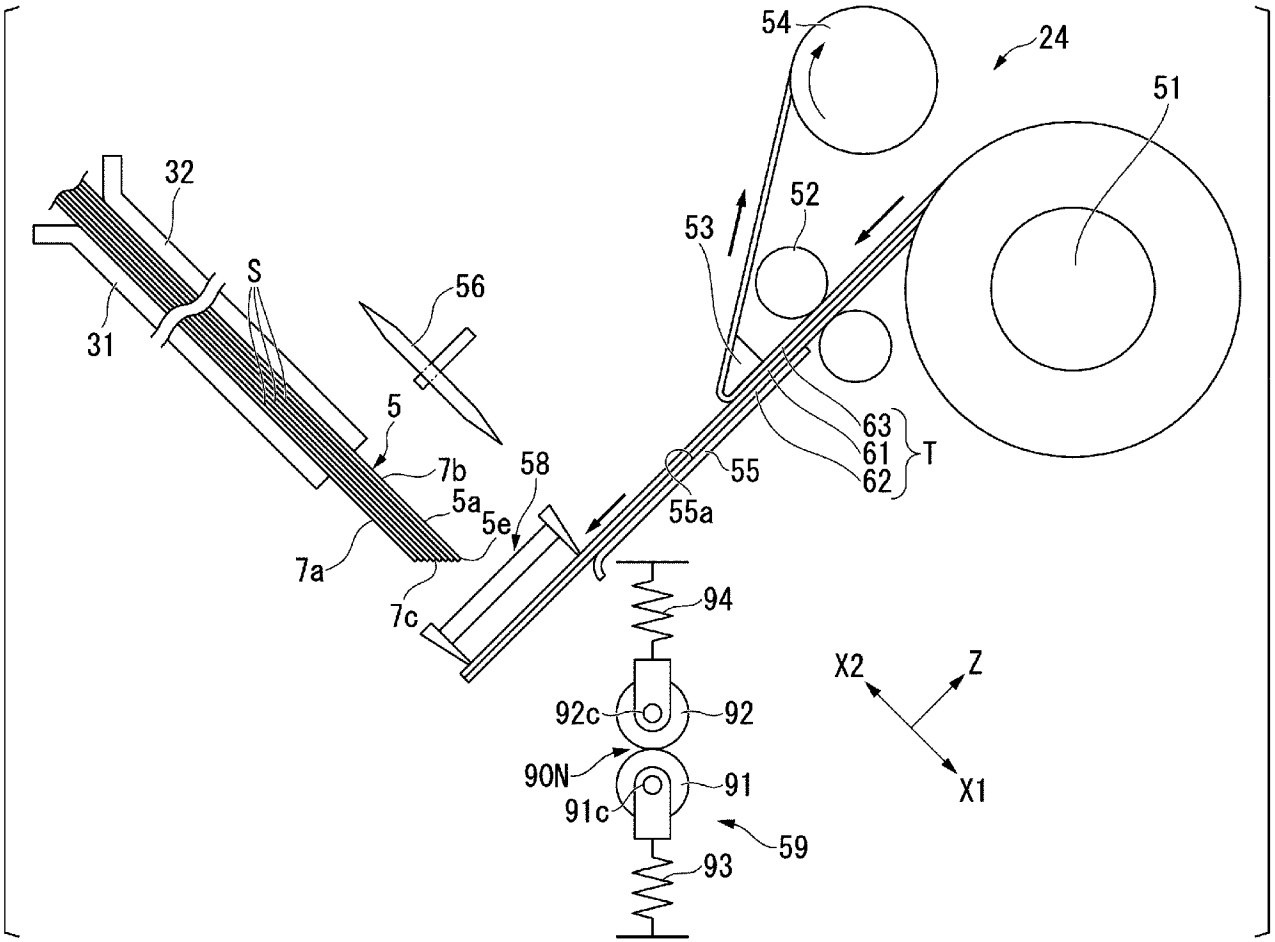

Subsequently, as illustrated in FIG. 7, the sheet binding apparatus 3 moves the tape holding section 58 to between the sheet bundle 5 and the tape attaching section 59. For example, the tape holding section 58 disposes the tape T to extend across the first roller 91 and the second roller 92. For example, the tape holding section 58 disposes the tape T such that the center of the linear tape T faces the nip 90N of the first roller 91 and the second roller 92. In other words, the tape holding section 58 causes the center between the first tape supporting section 58*a* and the second tape supporting section 58*b*, which hold the tape T, to face the nip 90N of the first roller 91 and the second roller 92.

Figure 8:
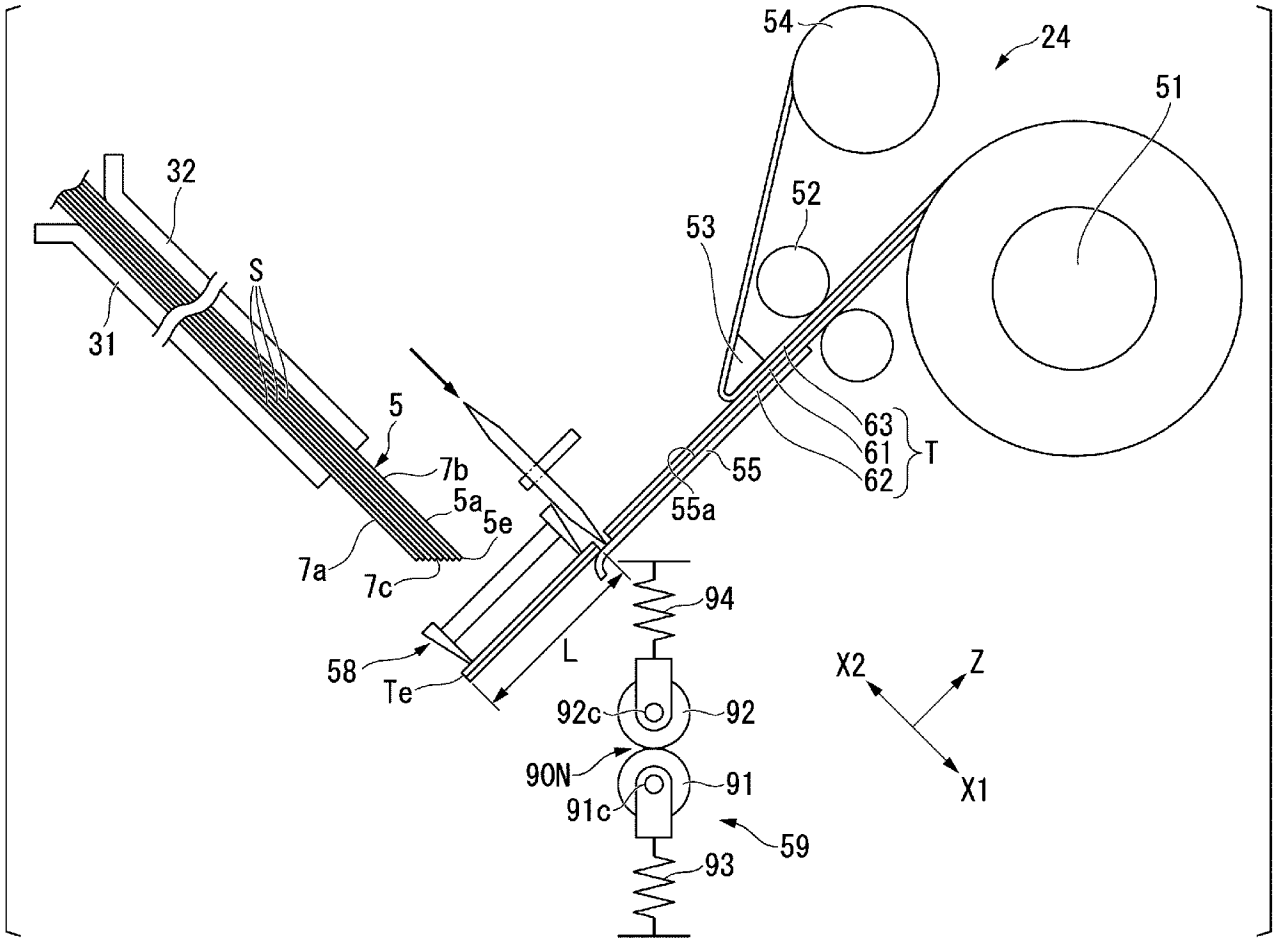

Subsequently, as illustrated in FIG. 8, the sheet binding apparatus 3 cuts the belt-like tape T with the cutter 56 to obtain a single piece of the tape T. Consequently, the tape T is cut in a necessary length.

Figure 9:
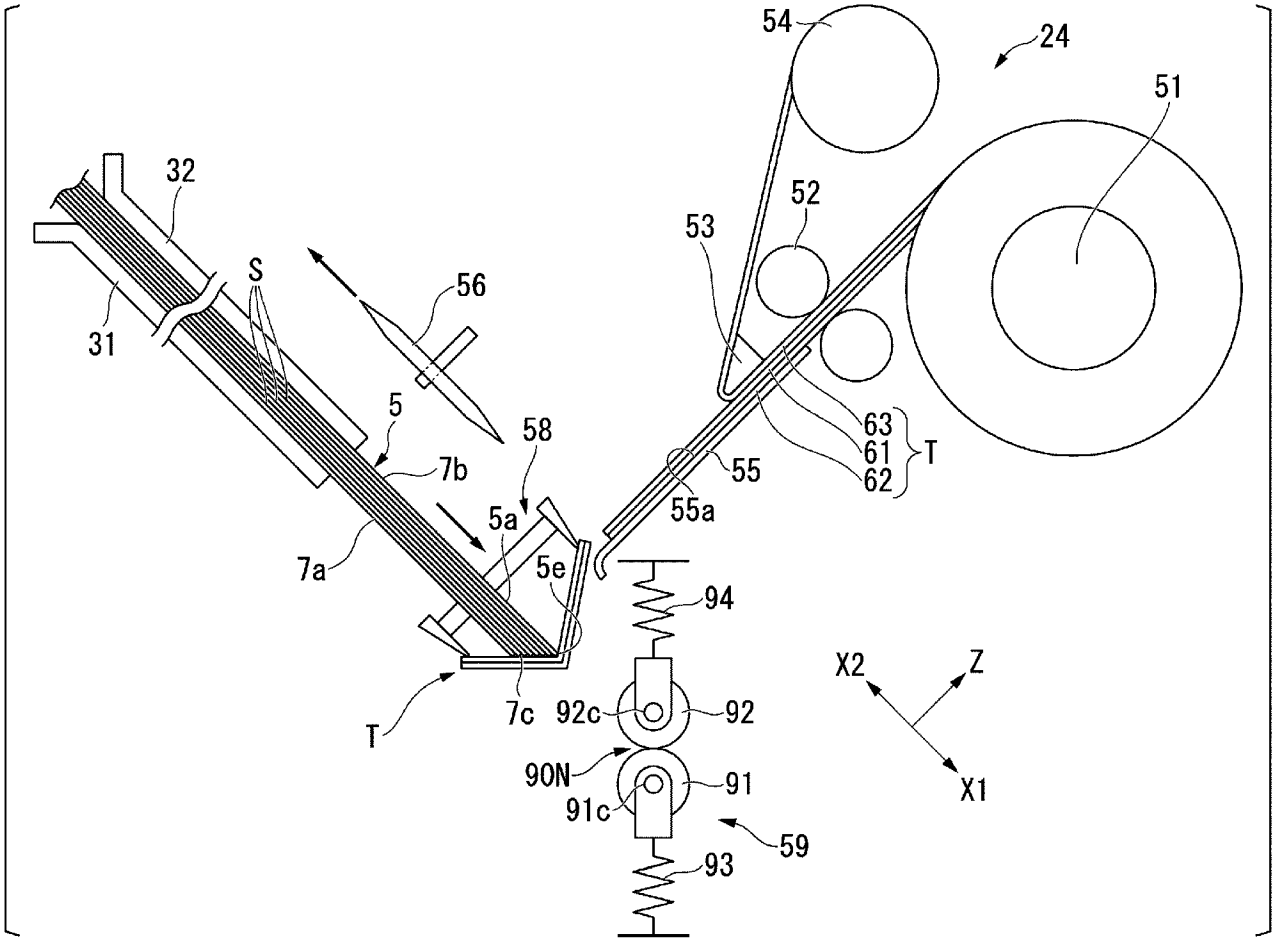

Subsequently, as illustrated in FIG. 9, the sheet binding apparatus 3 moves the sheet bundle 5 toward the tape attaching section 59 with the sheet shifting section 23 (see FIG. 2). For example, the sheet binding apparatus 3 normally rotates the first shifting roller 41 and the second shifting roller 42 (see FIG. 2) to move (insert) the sheet bundle 5 toward the tape attaching section 59. The sheet binding apparatus 3 conveys the sheet bundle 5 located between the main guide 31 and the sub-guide 32 toward between the first roller 91 and the second roller 92. The sheet binding apparatus 3 inserts the sheet bundle 5 into the tape T held by the tape holding section 58 to thereby peel the tape T from the tape holding section 58. The sheet binding apparatus 3 inserts the edge portion 5*a* of the sheet bundle 5 between the first roller 91 and the second roller 92 together with the tape T.

As illustrated in FIG. 10, if the edge portion 5*a* of the sheet bundle 5 is inserted between the first roller 91 and the second roller 92 together with the tape T, the first roller 91 and the second roller 92 move along the external shape of the edge portion 5*a* of the sheet bundle 5. Consequently, the first roller 91 and the second roller 92 press the tape T against the edge portion 5*a* of the sheet bundle 5. As a result, the tape T sequentially follows and adheres to a step-like portion of the sheet bundle 5. The edge portion 5*a* of the sheet bundle 5 includes the first surface 7*a*, the second surface 7*b*, and an end face 7*c*. The first surface 7*a* and the second surface 7*b* are surfaces extending along the sheet conveying direction X1. The second surface 7*b* is located on the opposite side of the first surface 7*a*. The end face 7*c* is located between the first surface 7*a* and the second surface 7*b*. The plurality of sheets S are shifted stepwise. At the edge portion 5*a* of the sheet bundle 5, the sheet S are attached across the first surface 7*a*, the end face 7*c*, and the second surface 7*b*. Consequently, all the sheets S including middle pages of the sheet bundle 5 are integrated by the tape T. Consequently, the processing for attaching the tape T to the edge portion 5*a* of the sheet bundle 5 is completed.

In this embodiment, if the edge portion 5*a* of the sheet bundle 5 is inserted between the first roller 91 and the second roller 92 together with the tape T, the first roller 91 and the second roller 92 respectively rotate around rotation axes 91*c* and 92*c*. After the insertion of the sheet bundle 5, the first roller 91 comes into contact with the end face 7*c* via the tape T in a state in which the second straight line B2 is substantially orthogonal to the end face 7*c*. Consequently, after the insertion of the sheet bundle 5, it is possible to substantially vertically press the tape T. Therefore, it is possible to apply a sufficient sticking force of the tape T to the edge portion 5*a* of the sheet bundle 5.

Figure 11:
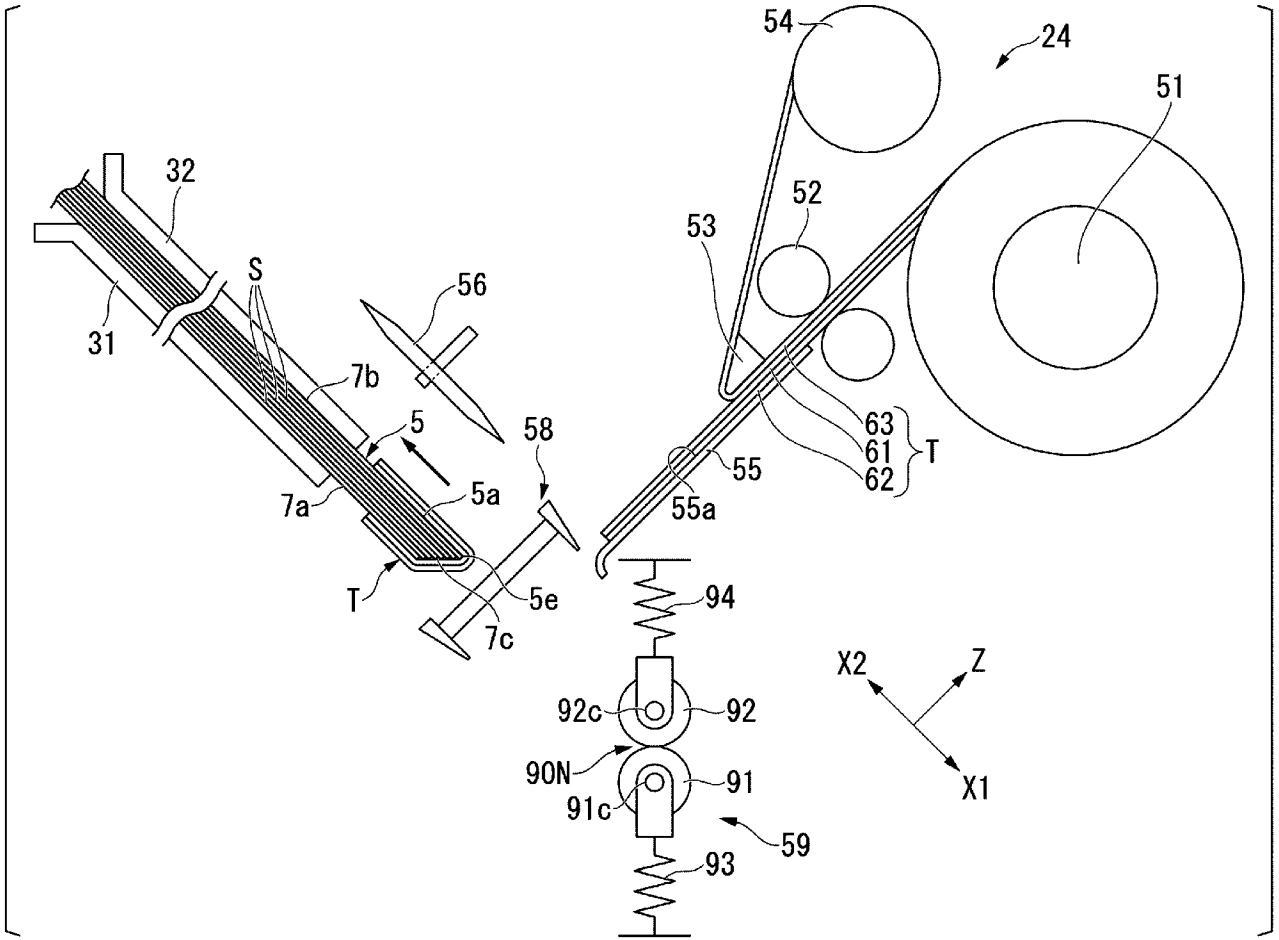

Subsequently, as illustrated in FIG. 11, the sheet binding apparatus 3 reversely rotates the first shifting roller 41 and the second shifting roller 42 to take out the sheet bundle 5 from between the first roller 91 and the second roller 92. The sheet binding apparatus 3 further reversely rotates the first shifting roller 41 and the second shifting roller 42 to discharge the sheet bundle 5 to a discharging section of the sheet binding apparatus 3.

A series of operation by the sheet binding apparatus 3 ends.

The operation of a sheet binding apparatus in a comparative example is described.

Figure 12:
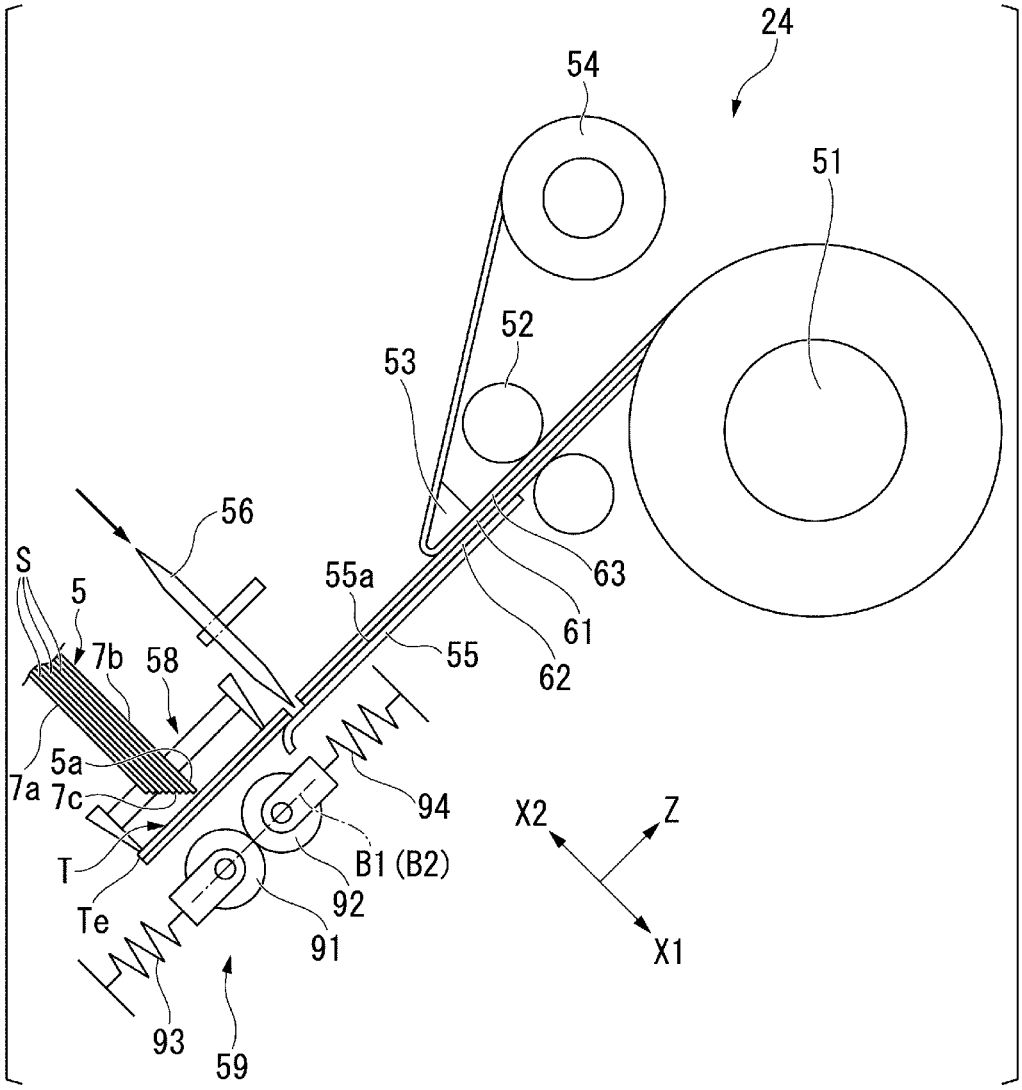
FIG. 12 illustrates a front view of a sheet binding apparatus in a comparative example.
Figure 13:
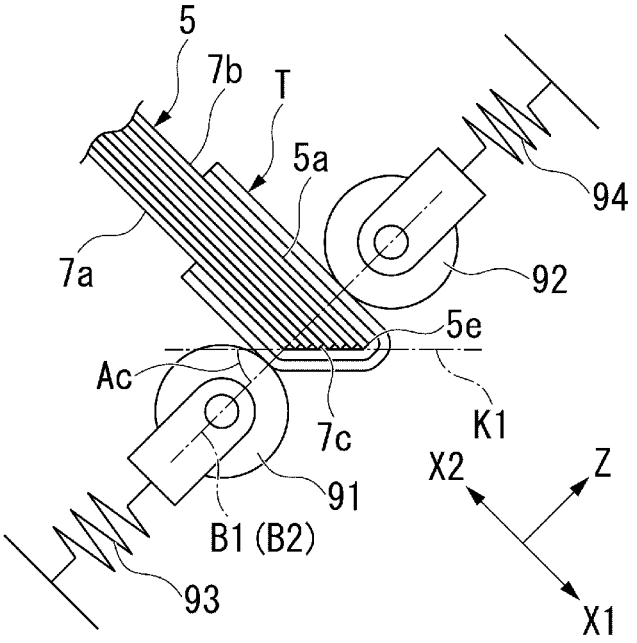
FIG. 13 illustrates a front view of the sheet binding apparatus in the comparative example performing an operation following the one illustrated in FIG. 12.

FIG. 12 illustrates a front view of the sheet binding apparatus in the comparative example that is performing an operation. FIG. 13 illustrates a front view of the sheet binding apparatus in the comparative example that is performing an operation following that illustrated in FIG. 12.

As illustrated in FIG. 12, the sheet binding apparatus in the comparative example does not satisfy $0° < Ab < 90°$.

Figure 14:
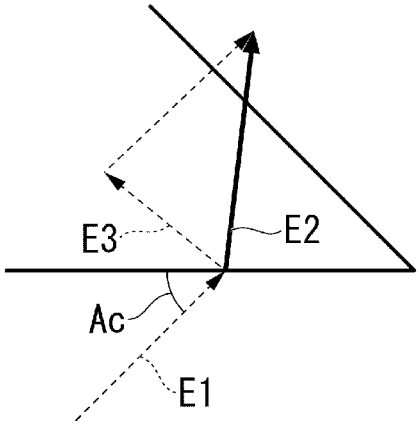
FIG. 14 is a diagram depicting an operation of the sheet binding apparatus in the comparative example.

In the comparative example, $Ab = 0°$. In the comparative example, the first straight line B1 and the second straight line B2 coincide. In the comparative example, if the shift angle A1 is set to 45°, the contact angle $Ac \propto 45°$ (see FIG. 13). In the comparative example, if there are a large number of sheets (e.g., three or more sheets) to be bound into the sheet bundle 5, it is likely that the pressing force between the first roller 91 and the second roller 92 (between the roller) is not uniformly applied to the step end face 7*c* (the tape T) of the sheet bundle 5. As illustrated in FIG. 14, if the contact angle Ac∝45°, a pressing force E1 of the first roller 91 applied to the tape T changes to component forces E2 and E3 on the step end face 7*c* of the sheet bundle 5. Consequently, it is highly likely that a pressing force applied to the tape T extending along the step end face 7*c* of the sheet bundle 5 decreases. In this case, it is highly likely that the pressing force between the rollers is not uniformly applied to the tape T. If the pressing force between the rollers is not uniformly applied to the tape T of the sheet bundle 5, the tape T cannot be sufficiently stuck to the edge portion 5*a* of the sheet bundle 5.

Figure 15:
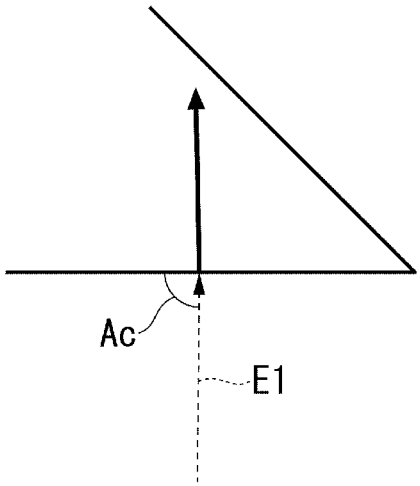
FIGS. 15 and 16 are diagrams depicting operations of a sheet binding apparatus according to a first embodiment.

On the other hand, in the embodiment, as illustrated in FIG. 5, 0°<Ab<90° is satisfied. In the embodiment, if the shift angle A1 is set to 45°, the contact angle Ac=90° (see FIG. 10). Therefore, it is less likely that the pressing force E1 of the first roller 91 applied to the tape T changes to component forces on the step end face 7*c* of the sheet bundle 5 (see FIG. 15). Therefore, it is less likely that the pressing force applied to the tape T extending along the step end face 7*c* of the sheet bundle 5 decreases. Accordingly, it is less likely that the pressing force between the rollers does not uniformly applied to the tape T. It is less likely that the tape T cannot be sufficiently stuck to the edge portion 5*a* of the sheet bundle 5.

Figure 16:
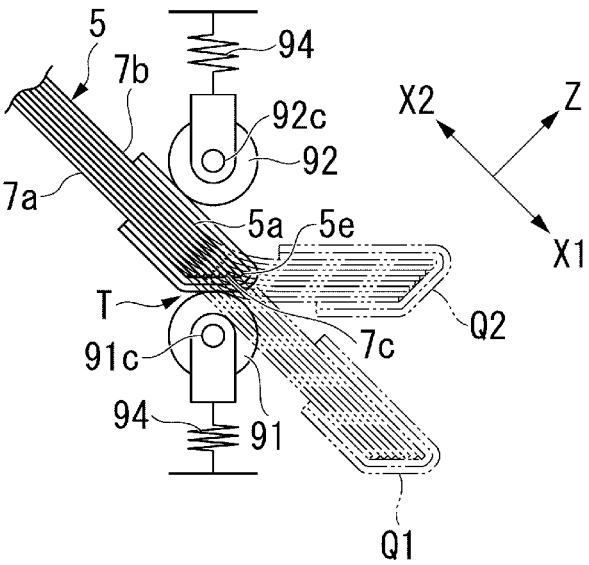

In FIG. 16, if the edge portion 5*a* of the sheet bundle 5 is inserted between the first roller 91 and the second roller 92 together with the tape T, a state in which an inserting direction of the sheet bundle 5 retains the entering direction is represented as a first state Q1 and a state in which the inserting direction of the sheet bundle 5 deviates from the entering direction is represented as a second state Q2. In the embodiment, if the shift angle A1 is set to 45° and the contact angle Ac is 90° or less (e.g., 80°≤Ac≤90°), it is more highly likely that the state of the inserting direction of the sheet bundle 5 is the second state Q2 than in the comparative example. In the embodiment, if the shift angle A1 is set to 45° and the contact angle Ac is larger than 90° (e.g., 90°≤Ac≤100°), it is more highly likely that the state of the inserting direction of the sheet bundle 5 is the second state Q2 than in the case of 80°≤Ac≤90°. In the case of the second state Q2, the sheet bundle 5 is twisted, whereby the tape T is rubbed against the step end face 7*c* of the sheet bundle 5. Therefore, the tape T is easily sufficiently stuck to the edge portion 5*a* of the sheet bundle 5.

According to the embodiment, the sheet binding apparatus 3 includes the first roller 91, the second roller 92, and the tape holding section 58. The second roller 92 is opposed to the first roller 91. The tape holding section 58 holds the tape T for binding the sheet bundle 5 shifted in a step shape. The first roller 91 is in contact with the step end face 7*c* of the sheet bundle 5 via the tape T. When viewed from the axial direction of the first roller 91, the first roller 91 is offset further to the downstream side than the second roller 92 in the entering direction. The imaginary line orthogonal to the entering direction when viewed from the axial direction of the first roller 91 is represented as the first straight line B1. The imaginary straight line passing the center of the first roller 91 and the center of the second roller 92 when viewed from the axial direction of the first roller 91 is represented as the second straight line B2. The angle formed by the first straight line B1 and the second straight line B2 when viewed from the axial direction of the first roller 91 is represented as Ab. The direction in which the second straight line B2 is rotated, based on the center of the second roller 92, from the position parallel to the first straight line B1 to the side of the entering direction when viewed from the axial direction of the first roller 91 is represented as the plus direction. In this case, 0°<Ab<90° is satisfied. With the configuration described above, the following effect is achieved.

Compared with the case of Ab=0°, the contact angle Ac can be brought close to 90°. Therefore, it is less likely that the pressing force E1 of the first roller 91 applied to the tape T changes to component forces on the step end face 7*c* of the sheet bundle 5. Accordingly, the pressing force between the rollers is easily uniformly applied to the tape T. Therefore, the tape T can be sufficiently stuck to the edge portion 5*a* of the sheet bundle 5.

As a result of the first roller 91 being in contact with the end face 7*c* via the tape T in a state in which the second straight line B2 is substantially orthogonal to the end face 7*c*, the following effect is achieved.

The tape T can be substantially vertically pressed on the step end face 7*c* of the sheet bundle 5. Therefore, the tape T can be more surely stuck to the edge portion 5*a* of the sheet bundle 5.

As a result of the sheet binding apparatus 3 further including the main guide 31 that guides the sheet bundle 5 shifted in the step shape to between the first roller 91 and the second roller 92, the following effect is achieved.

Since the sheet bundle 5 shifted in the step shape can be guided along the main guide 31, the sheet bundle 5 shifted in the step shape is easily guided in a target entering direction. Therefore, the tape T can be easily stuck to the edge portion 5*a* of the sheet bundle 5.

As a result of the first roller 91 being located on the downstream side of the second roller 92 in the entering direction, the following effect is achieved.

Compared with when the first roller 91 is located on the upstream side of the second roller 92 in the entering direction, it is easy to oppose the first roller 91 to the step end face 7*c* of the sheet bundle 5 while satisfying 0°<Ab<90°. Therefore, the tape T is easily sufficiently stuck to the edge portion 5*a* of the sheet bundle 5.

As a result of the first roller 91 having the perfect circular shape, the following effect is achieved.

Compared with when the first roller 91 has an elliptical shape, it is easy to cause the tape T to follow the step end face 7*c* of the sheet bundle 5. Therefore, the tape T can be smoothly attached to the edge portion 5*a* of the sheet bundle 5.

In addition, since each of the first roller 91 and the second roller 92 has the perfect circular shape, it is possible to bind the sheet bundle 5 using the first roller 91 and the second roller 92 having a simple shape.

As a result of the first roller 91 being formed of an elastic material, the following effect is achieved.

If the tape T is stuck to the edge portion 5*a* of the sheet bundle 5, the first roller 91 can be elastically deformed along the step end face 7*c* of the sheet bundle 5. Therefore, the tape T can be more surely stuck to the edge portion 5*a* of the sheet bundle 5.

As a result of the second roller 92 having rigidity larger than the rigidity of the first roller 91, the following effect is achieved.

Compared with when the second roller 92 has rigidity lower than the rigidity of the first roller 91, a surface on the opposite side of the step end face 7*c* of the sheet bundle 5 can be stably supported by the second roller 92. Therefore, if the tape T is stuck to the edge portion 5*a* of the sheet bundle 5, it is easy to oppose the first roller 91 to the step end face 7*c* of the sheet bundle 5. Therefore, the tape T is easily sufficiently stuck to the edge portion 5*a* of the sheet bundle 5.

The sheet binding apparatus 3 further includes the first spring 93 that urges the first roller 91 toward the second roller 92 and the second spring 94 that urges the second roller toward the first roller 91. With the configuration described above, the following effect is achieved.

Since it is possible to cause the tape T to follow the edge portion 5*a* of the sheet bundle 5, the sheet bundle 5 can be more surely bound.

As a result of the second spring 94 having a spring constant (a second spring constant) larger than the spring constant of the first spring 93, the following effect is achieved.

Compared with when the second spring 94 has a spring constant smaller than the spring constant of the first spring 93, it is easy to adjust a pressing force applied to the sheet bundle 5 while supporting, with the second roller 92, the surface on the opposite side of the step end face 7*c* of the sheet bundle 5.

A first modification of the first embodiment is described below.

Each of the first roller 91 and the second roller 92 is not limited to having the perfect circular shape.

Figure 17:
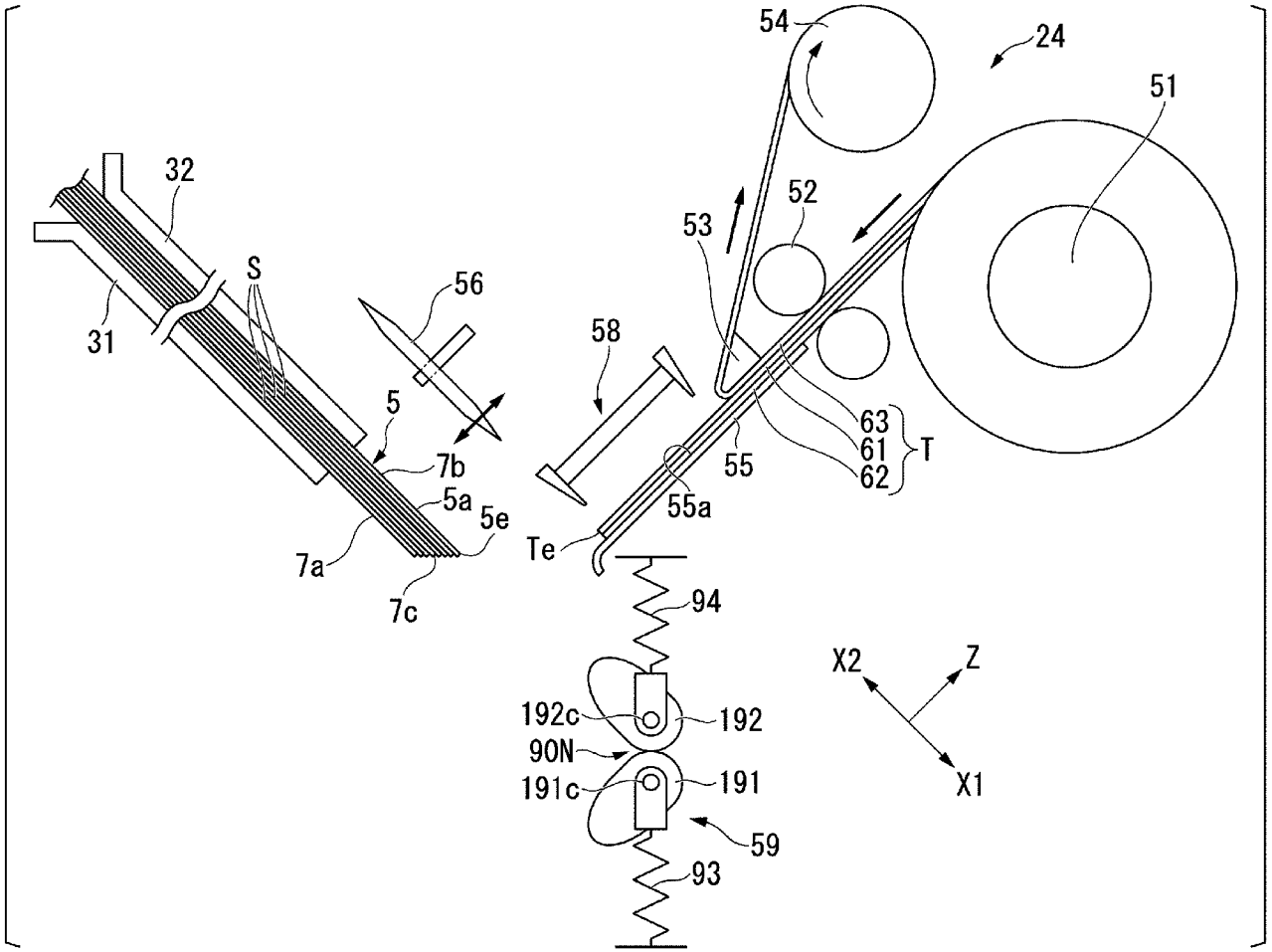
FIG. 17 illustrates a front view of a sheet binding apparatus in a first modification of the first embodiment.
Figure 18:
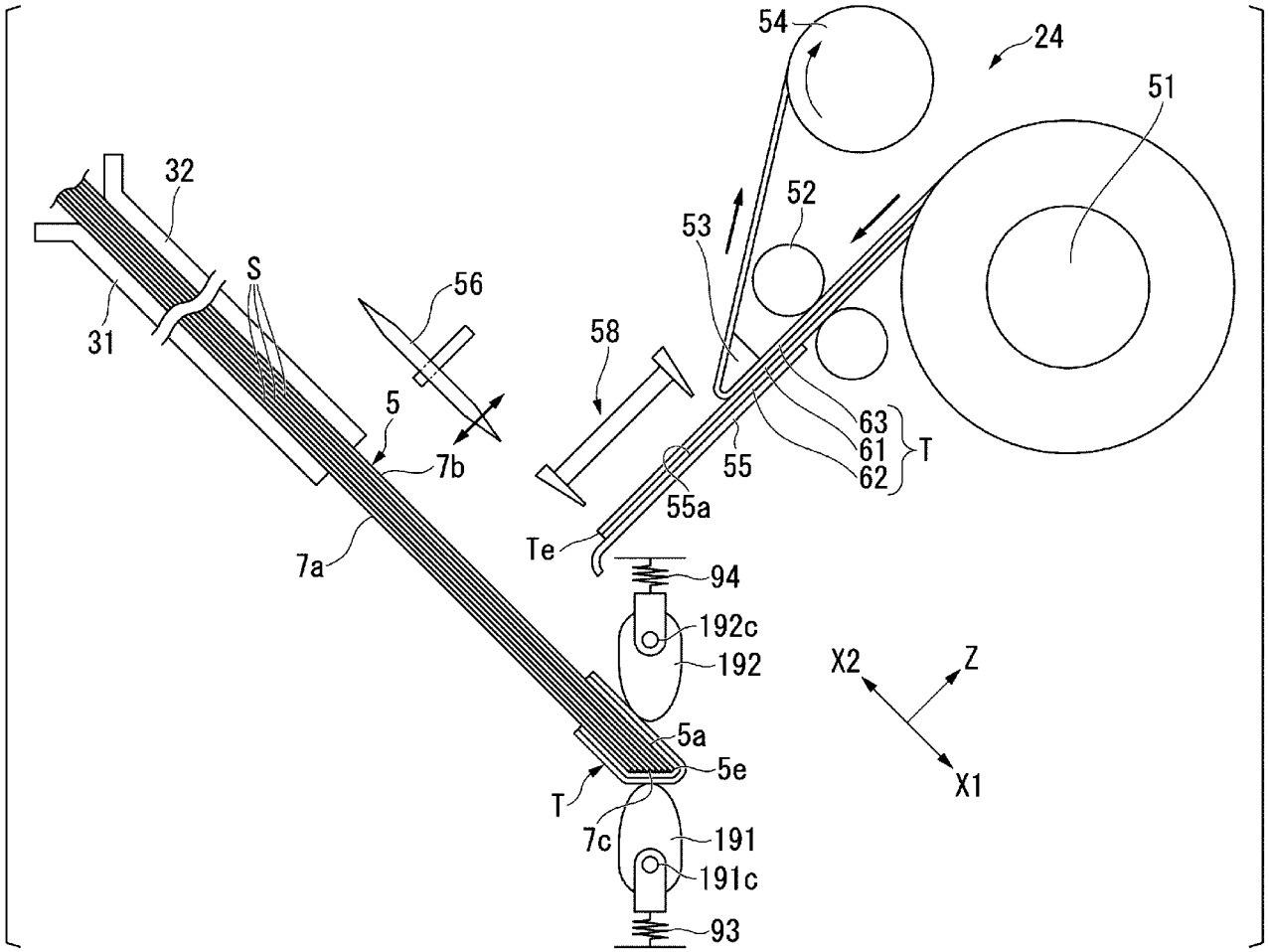
FIG. 18 is a diagram illustrating a state in which a first roller in the first modification is opposed to a step-like end face of a sheet bundle.

FIG. 17 illustrates a front view of a sheet binding apparatus in the first modification of the first embodiment. FIG. 18 is a diagram illustrating a state in which a first roller in the first modification of the first embodiment is opposed to a step-like end face of a sheet bundle.

As illustrated in FIG. 17, each of a first roller 191 and a second roller 192 may have a shape in which a radius before the insertion of the sheet bundle 5 is smaller than a threshold and a radius after the insertion of the sheet bundle 5 is equal to or larger than the threshold. The first roller 191 and the second roller 192 form the nip 90N into which the sheet bundle 5 is inserted. The radius before the insertion of the sheet bundle 5 means a distance from a rotation axis (an axis) before the insertion of the sheet bundle 5 to the nip 90N. The radius after the insertion of the sheet bundle 5 means a distance from the rotation axis (the axis) after the insertion of the sheet bundle 5 to the nip 90N (see FIG. 18).

In this modification, each of the first roller 191 and the second roller 192 has a cam shape. Rotation axes 191*c* and 192*c* of the rollers 191 and 192 deviate from the center positions of the rollers 191 and 192. The external shape of the rollers 191 and 192 is an elliptical shape (an oval shape). Before the sheet bundle 5 is inserted between the first roller 191 and the second roller 192, the first roller 191 and the second roller 192 open toward the upstream side in the entering direction (see FIG. 17).

According to the first modification of the first embodiment, each of the first roller 191 and the second roller 192 has the shape in which the radius before the insertion of the sheet bundle 5 is smaller than the threshold and the radius after the insertion of the sheet bundle 5 is equal to or larger than the threshold. With the configuration described above, the following effect is achieved.

It is possible to adjust a pressing force applied to the sheet bundle 5 making use of the shape of each of the first roller 191 and the second roller 192.

As a result that each of the first roller 191 and the second roller 192 has the cam shape, the following effect is achieved.

It is possible to adjust the pressing force applied to the sheet bundle 5 with a simple configuration that makes use of the cam shape of the rollers 191 and 192.

As a result of the first roller 191 and the second roller 192 opening toward the upstream side in the entering direction before the sheet bundle 5 is inserted between the first roller 191 and the second roller 192, the following effect is achieved.

Compared with when the first roller 191 and the second roller 192 close toward the upstream side in the entering direction, it is easier to rush the sheet bundle 5 into between the first roller 191 and the second roller 192. In addition, after the sheet bundle 5 is rushed into between the first roller 191 and the second roller 192, the pressing force applied to the sheet bundle 5 can be increased.

A second modification of the first embodiment is described.

Figure 19:
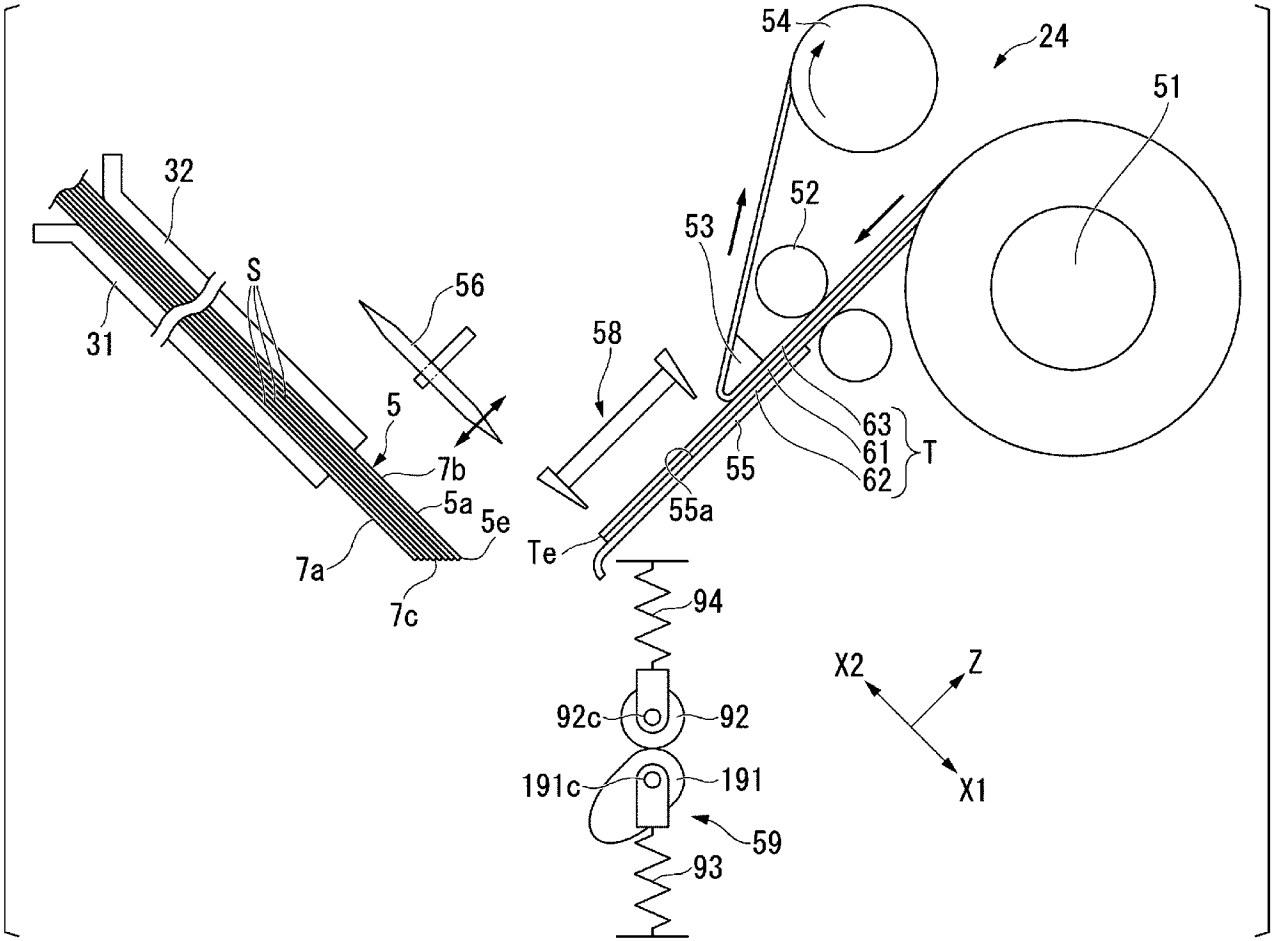
FIG. 19 illustrates a front view illustrating a sheet binding apparatus in a second modification of the first embodiment.

FIG. 19 illustrates a front view of a sheet binding apparatus in a second modification of the first embodiment. As illustrated in FIG. 19, the first roller 191 may have a cam shape. The rotation axis 191*c* of the first roller 191 deviates from the center position of the first roller 191. The external shape of the first roller 191 is an elliptical shape.

According to the second modification of the first embodiment, the first roller 191 has the cam shape. The second roller 92 has a perfect circular shape. With the configuration described above, the following effect is achieved.

It is possible to adjust a pressing force applied to the sheet bundle 5 with a simple configuration that makes use of the cam shape of the first roller 191.

A third modification of the first embodiment is described.

The sheet binding apparatus is not limited to including the second spring 94 (see FIG. 5) that urges the second roller 92 toward the first roller 91. This modification is different from the first embodiment in that the sheet binding apparatus does not include the second spring 94 (the urging member). In other words, in this modification, the first roller 91 of the first and second rollers 91 and 92 includes the urging member.

Figure 20:
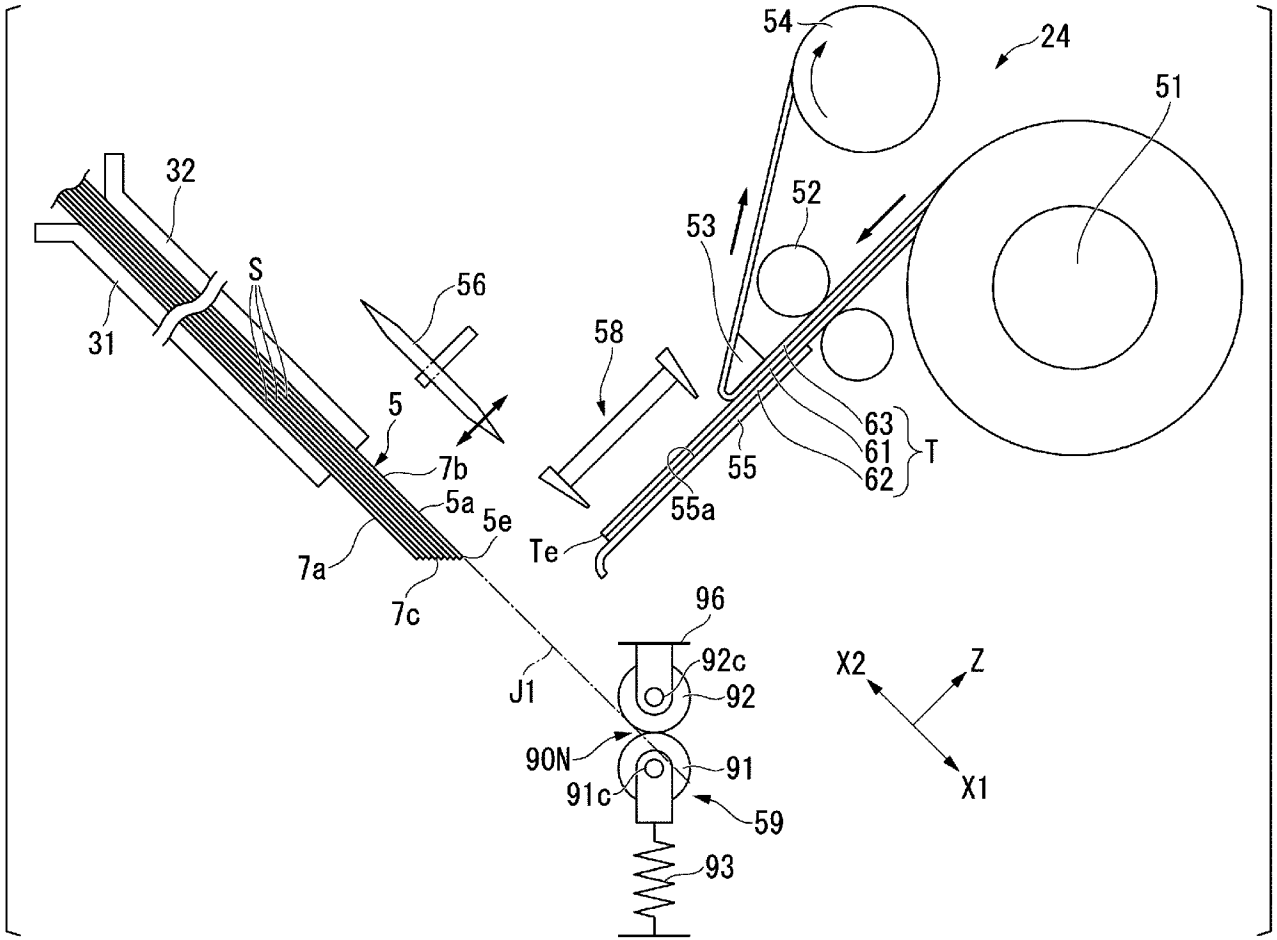
FIG. 20 illustrates a front view of a sheet binding apparatus in a third modification of the first embodiment.

FIG. 20 illustrates a front view of a sheet binding apparatus in a third modification of the first embodiment.

As illustrated in FIG. 20, the sheet binding apparatus includes a supporting member 96 that rotatably supports the second roller 92. The supporting member 96 supports the second roller 92 in a fixed position.

The main guide 31 guides the sheet bundle 5 to cause an edge portion leading end 5*e* of the sheet bundle 5 to face a nip forming end of the second roller 92. The nip forming end of the second roller 92 means, in the outer circumferential surface of the second roller 92, a portion that forms the nip 90N in cooperation with the first roller 91. The nip forming end of the second roller 92 is equivalent to an end edge closest to the first roller 91 in the sheet bundle thickness direction Z in the second roller 92. A sign J1 in FIG. 20 indicates an imaginary straight line that passes the edge portion leading end 5*e* of the sheet bundle 5 and the nip forming end of the second roller 92.

According to the third modification of the first embodiment, the sheet binding apparatus includes the supporting member 96 that rotatably supports the second roller 92. The main guide 31 guides the sheet bundle 5 to cause the edge portion leading end 5*e* of the sheet bundle 5 to face the nip forming end of the second roller 92. With the configuration described above, the following effect is achieved.

Compared with when the sheet bundle 5 is guided to a position where the edge portion leading end 5*e* of the sheet bundle 5 deviates from the nip forming end of the second roller 92, it is easy to rush the sheet bundle 5 into between the first roller 91 and the second roller 92.

A fourth modification of the first embodiment is described.

The main guide 31 is not limited to guiding a surface on the side of the step end face 7*c* of the sheet bundle 5.

Figure 21:
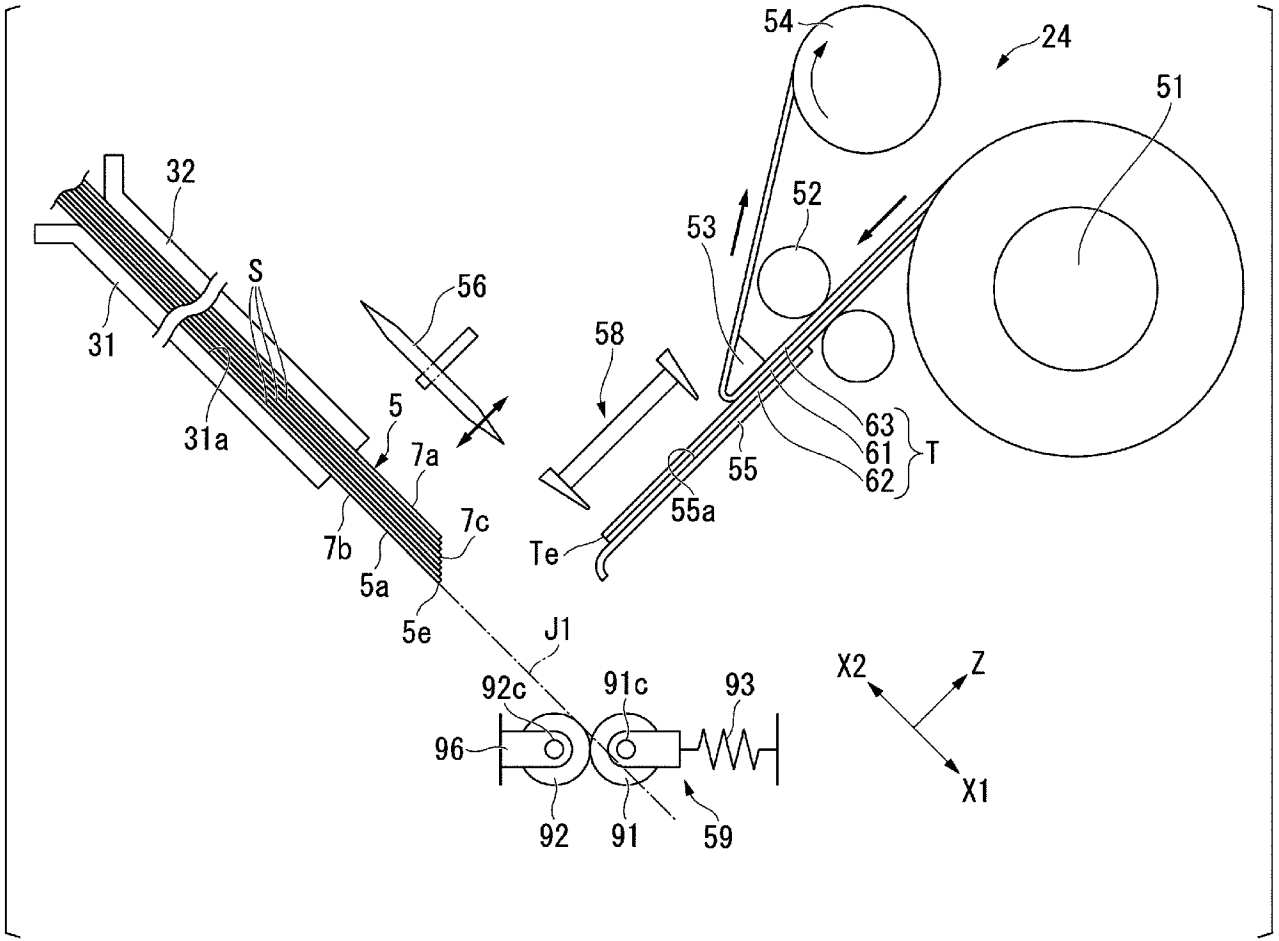
FIG. 21 illustrates a front view of a sheet binding apparatus in a fourth modification of the first embodiment.

FIG. 21 illustrates a front view of a sheet binding apparatus in the fourth modification of the first embodiment.

As illustrated in FIG. 21, the main guide 31 may guide the surface (the second surface 7*b*) on the opposite side of the step end face 7*c* of the sheet bundle 5. The main guide 31 includes a guide surface 31*a* extending in a direction crossing the vertical plane when viewed from the axial direction of the first roller 91. If the shift angle A1 is set to 45°, the guide surface 31*a* inclines at 45° with respect to the vertical plane. In this modification, a direction of the step end face 7*c* of the sheet bundle 5 is opposite to the direction in the third modification (see FIG. 20). In addition, an arrangement direction of the first roller 91, the second roller 92, and the like is opposite to the arrangement direction in the third modification. In this modification, the first roller 91 and the second roller 92 are substantially horizontally disposed side by side.

According to the fourth modification of the first embodiment, the main guide 31 includes the guide surface 31*a* that extends in the direction crossing the vertical plane when viewed from the axial direction of the first roller 91. The guide surface 31*a* guides the surface on the opposite side of the step end face 7*c* of the sheet bundle 5. With the configuration described above, the following effect is achieved.

Compared with when the guide surface 31*a* guides the surface on the side of the step end face 7*c* of the sheet bundle 5, since a contact area of the sheet bundle 5 and the guide surface 31*a* increases, it is easy to stably convey the sheet bundle 5. Therefore, if the tape T is stuck to the edge portion 5*a* of the sheet bundle 5, it is easy to oppose the first roller 91 to the step end face 7*c* of the sheet bundle 5. Therefore, the tape T is easily sufficiently stuck to the edge portion 5*a* of the sheet bundle 5.

A second embodiment is described. In the second embodiment, description is omitted concerning the same components as the components in the first embodiment.

The sheet binding apparatus is not limited to including the sheet shifting section 23 (the first shifting roller 41 and the second shifting roller 42). The second embodiment is different from the first embodiment in that the sheet binding apparatus includes a shifting mechanism.

Figure 22:
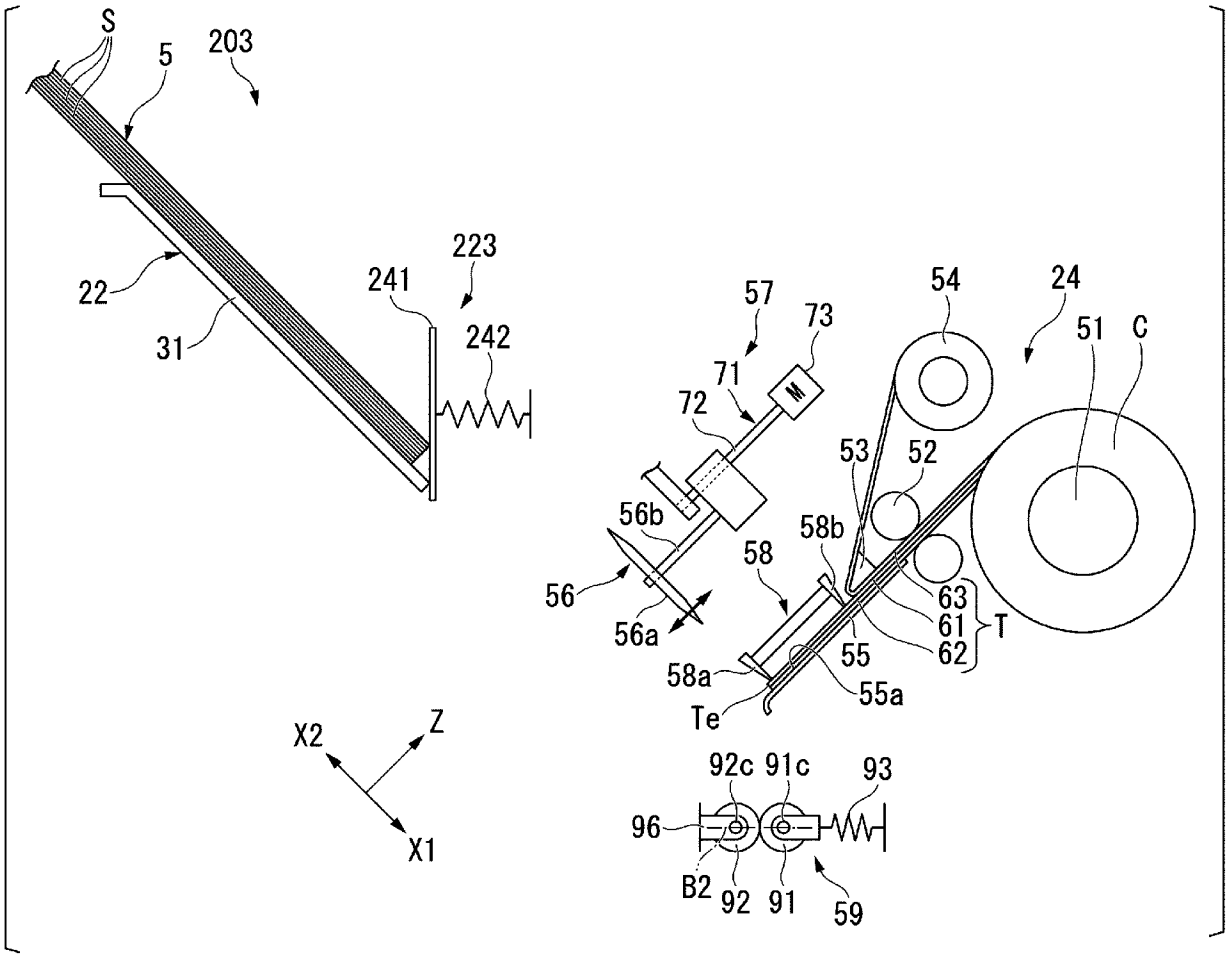
FIG. 22 illustrates a front view of a sheet binding apparatus according to a second embodiment.

FIG. 22 illustrates a front view of a sheet binding apparatus 203 according to the second embodiment.

As illustrated in FIG. 22, the sheet binding apparatus 203 includes a shifting mechanism 223 for shifting the sheet bundle 5 stepwise. The shifting mechanism 223 is located on the upstream side of the tape holding section 58 in the entering direction. The shifting mechanism 223 includes an end-face forming plate 241 and a spring 242 (an urging member for end face formation).

The end-face forming plate 241 is formed in a plate shape extending in the direction obliquely crossing the entering direction when viewed from the axial direction of the first roller 91. The end-face forming plate 241 is a member for forming the step end face 7*c* (see FIG. 23) in the sheet bundle 5. The end-face forming plate 241 linearly extends substantially in parallel to the step end face 7*c* of the target sheet bundle 5.

The spring 242 urges the end-face forming plate 241 toward the sheet bundle 5. The spring 242 is stretchable substantially in parallel to the second straight line B2. The spring 242 always urges the end-face forming plate 241 toward the main guide 31.

Figure 23:
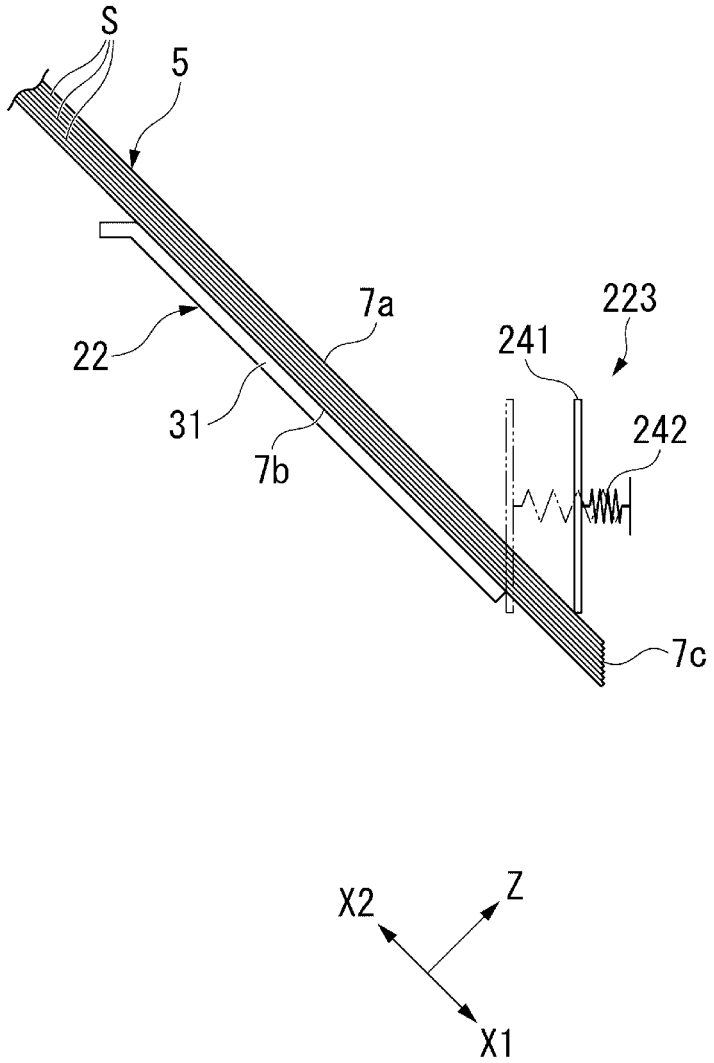
FIG. 23 is a diagram illustrating an operation for changing a shift amount among sheets in the sheet binding apparatus.

The main guide 31 guides the surface (the second surface 7*b*) on the opposite side of the step end face 7*c* of the sheet bundle 5 (see FIG. 23). In the second embodiment, a direction of the step end face 7*c* of the sheet bundle 5 is opposite to the direction in the first embodiment. In addition, an arrangement direction of the first roller 91, the second roller 92, and the like is opposite to the arrangement direction in the first embodiment (same as the arrangement direction in the fourth modification).

A state before the sheet bundle 5 is guided to the main guide 31 is represented as an "initial state". In the initial state, the end-face forming plate 241 is in close contact with the main guide 31 by the urging of the spring 242. In the initial state, the end-face forming plate 241 is inclined with respect to the main guide 31 to form an angle substantially the same as a target inclination angle. If the sheet bundle 5 is guided to the main guide 31, the edge portion of the sheet bundle 5 comes into contact with the end-face forming plate 241 (the end-face forming plate 241 indicated by an alternate long and two short dashes line in FIG. 23). Consequently, the edge portion of the sheet bundle 5 is shifted stepwise. If the sheet bundle 5 shifted stepwise is guided to the entering direction downstream side resisting the urging force of the spring 242, the end-face forming plate 241 separates from the main guide 31 (the end-face forming plate 241 indicated by a solid line in FIG. 23). If the end-face forming plate 241 separates from the main guide 31, a gap is formed between the end-face forming plate 241 and the main guide 31. Consequently, it is possible to guide the sheet bundle 5 shifted stepwise to the entering direction downstream side through the gap.

According to the second embodiment, the sheet binding apparatus 203 includes the shifting mechanism 223 for shifting the sheet bundle 5 stepwise. The shifting mechanism 223 is located on the upstream side of the tape holding section 58 in the entering direction. With the configuration described above, the following effect is achieved.

The step end face 7*c* of the target sheet bundle 5 can be formed on the upstream side of the tape holding section 58 in the entering direction. Therefore, the step end face 7*c* less easily comes apart compared with when the step end face 7*c* is formed according to user option. Therefore, the tape T is easily sufficiently stuck to the edge portion 5*a* of the sheet bundle 5.

The shifting mechanism 223 includes the end-face forming plate 241 and the spring 242. The end-face forming plate 241 is formed in a plate shape extending in the direction crossing the entering direction when viewed from the axial direction of the first roller 91. The spring 242 urges the end-face forming plate 241 toward the sheet bundle 5. With the configuration described above, the following effect is achieved.

The step end face 7*c* of the target sheet bundle 5 can be formed by a simple configuration including the end-face forming plate 241 and the spring 242.

Another modification of the embodiment is described.

The roller interval is not limited to zero before the sheet bundle 5 is inserted between the first roller 91 and the second roller 92. For example, the roller interval may be the same as the thickness of the sheet bundle 5 before the sheet bundle 5 is inserted between the first roller 91 and the second roller 92. That is, the roller interval may be larger than zero and equal to or smaller than the thickness of the sheet bundle 5 before the sheet bundle 5 is inserted between the first roller 91 and the second roller 92.

The sheet binding apparatus is not limited to including the main guide 31 that is provided between the first roller 91 and the second roller 92 and guides the sheet bundle 5 and the sub-guide 32 opposed to the main guide 31 in the sheet bundle thickness direction Z. For example, the sheet binding apparatus may not include the sub-guide 32. For example, the sheet binding apparatus may include the main guide 31.

According to at least one embodiment described above, the sheet binding apparatus 3 includes the first roller 91, the second roller 92, and the tape holding section 58. The second roller 92 is opposed to the first roller 91. The tape holding section 58 holds the tape T for binding the sheet bundle 5 shifted stepwise. The first roller 91 is in contact with the step end face 7*c* of the sheet bundle 5 via the tape T. The first roller 91 is offset further to the downstream side than the second roller 92 in the entering direction when viewed from the axial direction of the first roller 91. The imaginary straight line orthogonal to the entering direction when viewed from the axial direction of the first roller 91 is represented as the first straight line B1. The imaginary straight line passing the center of the first roller 91 and the center of the second roller 92 when viewed from the axial direction of the first roller 91 is represented as the second straight line B2. The angle formed by the first straight line B1 and the second straight line B2 when viewed from the axial direction of the first roller 91 is represented as Ab. The direction in which the second straight line B2 is rotated, based on the center of the second roller 92, from the position parallel to the first straight line B1 to the side of the entering direction is represented as the plus direction. In this case, $0° \leq Ab \leq 90°$ is satisfied. With the configuration described above, the following effect is achieved.

Compared with the case of $Ab=0°$, the contact angle Ac can be brought close to 90°. Therefore, it is less likely that the pressing force E1 of the first roller 91 applied to the tape T changes to component forces on the step end face 7*c* of the sheet bundle 5. Accordingly, the pressing force between the rollers is easily uniformly applied to the tape T. Therefore, the tape can be sufficiently stuck to the edge portion 5*a* of the sheet bundle 5.

While certain embodiments have been described these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A sheet binding apparatus, comprising:

a sheet conveyer configured to convey a sheet bundle with a leading end thereof in a sheet forward direction shifted in a stepwise manner, the sheet bundle having opposing first and second surfaces;

a tape holder configured to hold a tape at a position which the leading end of the sheet bundle reaches as the sheet bundle is conveyed in the sheet forward direction by the sheet conveyer such that the tape adheres to the leading end of the sheet bundle; and a first roller and a second roller between which the leading end of the sheet bundle with the tape passes and is pressed as the sheet bundle is conveyed in the forward direction, wherein the second roller is upstream in the sheet forward direction from the first roller and faces the second surface of the sheet bundle, and an angle between a first straight line perpendicular to the sheet forward direction and a second straight line passing through a rotational axis of the first roller and a rotational axis of the second roller is greater than 0° and less than 90°.

2. The sheet binding apparatus according to claim 1, wherein the angle is greater than 10° and less than 80°.

3. The sheet binding apparatus according to claim 1, wherein the angle is greater than 20° and less than 70°.

4. The sheet binding apparatus according to claim 1, wherein the first and second rollers are positioned such that a leading side edge of the sheet bundle in the sheet forward direction is substantially perpendicular to the second straight line.

5. The sheet binding apparatus according to claim 1, wherein a rigidity of the second roller is greater than a rigidity of the first roller.

6. The sheet binding apparatus according to claim 1, wherein the first roller is mechanically urged toward the second roller and the second roller is mechanically urged toward the first roller.

7. The sheet binding apparatus according to claim 1, wherein the first roller is mechanically urged toward the second roller and the second roller is fixed.

8. The sheet binding apparatus according to claim 1, wherein the sheet conveyer includes a first shifting roller and a second shifting roller forming a nip, the first and second shifting rollers being configured to cause the leading end of the sheet bundle to be shifted as the sheet bundle is conveyed through the nip.

9. A sheet binding apparatus comprising:

a sheet guide configured to guide a sheet bundle, the sheet bundle having opposing first and second surfaces;

a shifting device configured to cause a leading end, in a sheet forward direction, of the sheet bundle on the sheet guide to be shifted in a stepwise manner;

a tape holder configured to hold a tape at a position which the leading end of the sheet bundle reaches as the sheet bundle is guided in the sheet forward direction by the sheet guide such that the tape adheres to the leading end of the sheet bundle; and a first roller and a second roller between which the leading end of the sheet bundle and the tape passes and is pressed as the sheet bundle is guided in the forward direction, wherein the second roller is upstream in the sheet forward direction from the first roller and faces the second surface of the sheet bundle, and an angle between a first straight line perpendicular to the sheet forward direction and a second straight line passing through a rotational axis of the first roller and a rotational axis of the second roller is greater than 0° and less than 90°.

10. The sheet binding apparatus according to claim 9, wherein the angle is greater than 10° and less than 80°.

11. The sheet binding apparatus according to claim 9, wherein the angle is greater than 20° and less than 70°.

12. The sheet binding apparatus according to claim 9, wherein the first and second rollers are positioned, such that a leading side edge of the sheet bundle in the sheet forward direction is substantially perpendicular to the second straight line.

13. The sheet binding apparatus according to claim 9, wherein a rigidity of the second roller is greater than a rigidity of the first roller.

14. The sheet binding apparatus according to claim 9, wherein the first roller is mechanically urged toward the second roller and the second roller is mechanically urged toward the first roller.

15. The sheet binding apparatus according to claim 9, wherein the first roller is mechanically urged toward the second roller and the second roller is fixed.

16. The sheet binding apparatus according to claim 9, wherein the shifting device includes a first shifting roller and a second shifting roller forming a nip, the first and second shifting rollers being configured to cause the leading end of the sheet bundle to be shifted as the sheet bundle is guided through the nip.

17. The sheet binding apparatus according to claim 9, wherein the shifting device includes a plate pressed towards a guide surface of the sheet guide at an angle equal to or greater than 15° and equal to or less than 60° with respect to the guide surface, the plate being at a position which the leading end of the sheet bundle contacts when guided in the sheet forward direction by the sheet guide.

18. An image forming system, comprising:

an image forming apparatus configured to discharge printed sheets; and a sheet binding apparatus configured to bind printed sheets discharged from the image forming apparatus, the sheet binding apparatus comprising:

a sheet conveyer configured to convey a sheet bundle with a leading end thereof in a sheet forward direction shifted in a stepwise manner, the sheet bundle having opposing first and second surfaces;

a tape holder configured to hold a tape at a position which the leading end of the sheet bundle reaches as the sheet bundle is conveyed in the sheet forward direction by the sheet conveyer such that the tape adheres to the leading end of the sheet bundle; and a first roller and a second roller between which the leading end of the sheet bundle with the tape passes and is pressed as the sheet bundle is conveyed in the forward direction, wherein the second roller is upstream in the sheet forward direction from the first roller and faces the second surface of the sheet bundle, and an angle between a first straight line perpendicular to the sheet forward direction and a second straight line passing through a rotational axis of the first roller and a rotational axis of the second roller is greater than 0° and less than 90°.

19. The sheet binding system according to claim 18, wherein the angle is greater than 10° and less than 80°.

20. The sheet binding system according to claim 18, wherein the angle is greater than 20° and less than 70°.

* * * * *